US007938761B2

(12) United States Patent
Simonson et al.

(10) Patent No.: US 7,938,761 B2
(45) Date of Patent: May 10, 2011

(54) MULTI AXES EXERCISE APPARATUS

(76) Inventors: Tom Simonson, Kiester, MN (US); Nate Fryer, Broomfield, CO (US); Paul R. Jeselnick, Denver, CO (US)

( * ) Notice: Subject to any disclaimer, the term of this patent is extended or adjusted under 35 U.S.C. 154(b) by 191 days.

(21) Appl. No.: 12/170,118

(22) Filed: Jul. 9, 2008

(65) Prior Publication Data

US 2010/0009818 A1 Jan. 14, 2010

(51) Int. Cl.
*A63B 21/062* (2006.01)
*A63B 21/00* (2006.01)

(52) U.S. Cl. ..... 482/100; 482/136; 482/138

(58) Field of Classification Search ..... 482/97, 482/148, 100–103, 136–138
See application file for complete search history.

(56) References Cited

U.S. PATENT DOCUMENTS 4,603,855 A * 8/1986 Sebelle ..... 482/103
4,720,096 A 1/1988 Rogers
5,273,504 A * 12/1993 Jones ..... 482/97
5,273,505 A * 12/1993 Jones ..... 482/97
5,342,270 A * 8/1994 Jones ..... 482/98
5,554,089 A * 9/1996 Jones ..... 482/97
RE35,470 E * 3/1997 Jones ..... 482/97
5,643,152 A * 7/1997 Simonson ..... 482/100
5,667,464 A * 9/1997 Simonson ..... 482/97
5,707,323 A * 1/1998 Simonson ..... 482/97
5,788,614 A * 8/1998 Simonson ..... 482/97
5,810,701 A * 9/1998 Ellis et al. ..... 482/136
5,997,447 A * 12/1999 Giannelli et al. ..... 482/100
6,010,437 A * 1/2000 Jones ..... 482/97
6,203,474 B1 * 3/2001 Jones ..... 482/97
6,234,941 B1 * 5/2001 Chu ..... 482/100
6,358,189 B1 3/2002 Koenig
6,387,020 B1 * 5/2002 Simonson ..... 482/99
6,394,936 B1 * 5/2002 Voris ..... 482/100
6,482,135 B1 11/2002 Ish, III et al.
6,500,106 B1 * 12/2002 Fulks ..... 482/137
6,533,709 B1 * 3/2003 Jones ..... 482/97
6,579,213 B1 * 6/2003 Webber et al. ..... 482/100
6,592,498 B1 * 7/2003 Trainor ..... 482/97
6,689,023 B2 * 2/2004 Baumler ..... 482/100
7,169,093 B2 * 1/2007 Simonson et al. ..... 482/103
7,322,906 B2 * 1/2008 Webber ..... 482/100
7,563,214 B2 * 7/2009 Webber et al. ..... 482/135
7,597,655 B2 * 10/2009 Webber et al. ..... 482/136
7,641,602 B2 * 1/2010 Rogers et al. ..... 482/100
7,833,138 B1 * 11/2010 Fulks ..... 482/97
2001/0001776 A1 * 5/2001 Jones ..... 482/97
2002/0107117 A1 * 8/2002 Carter ..... 482/100
2003/0195091 A1 * 10/2003 Webber et al. ..... 482/100
2004/0029688 A1 * 2/2004 Webber et al. ..... 482/142
2006/0189457 A1 * 8/2006 Ripley ..... 482/99

(Continued)

*Primary Examiner* — Rinaldi I Rada
*Assistant Examiner* — Robert F Long
(74) *Attorney, Agent, or Firm* — Roger A. Jackson

(57) ABSTRACT

An apparatus and method for an exercise apparatus is disclosed that includes a base structure, a multiple axes pivotal mechanism disposed adjacent to the base structure, and an arm. The arm further includes a distal end portion and a proximal end portion with a longitudinal axis spanning therebetween. The distal and proximal end portions are each adapted to provide independent resistive force to muscle exertion, with the proximal end portion being adjacent to the mechanism such that operationally at least two independent axes of movement occur in the arm relative to the structure. Also included in the exercise apparatus is an assemblage for creating selectable variable resistance forces to the movement of the arm relative to the structure, such that each axis of movement has an independent selectable variable resistance force to the arm movement.

12 Claims, 36 Drawing Sheets

U.S. PATENT DOCUMENTS

2007/0042877 A1* 2/2007 Choi ..... 482/97
2007/0093364 A1* 4/2007 Batca ..... 482/99
2008/0227606 A1* 9/2008 Fedriga et al. ..... 482/97
2010/0016129 A1* 1/2010 Chou ..... 482/97

* cited by examiner

MULTI AXES EXERCISE APPARATUS

TECHNICAL FIELD

The present invention generally relates to an apparatus for accomplishing exercise in a traditional exercise or working out environment, wherein an individual does have ready access to a gym, health club, spa, or other type of facility for exercise or working out, or alternatively in some cases in a home gym. More particularly, the present invention is a multi-axes exercise apparatus that is adapted to enhance a user's workout in comparison with that of a traditional single-axis exercise apparatus. The present invention further allows the individual to enjoy the health, conditioning, and strength benefits of exercise in a more efficient manner by exercising additional muscle groups with a singular motion as compared to the conventional or traditional exercise machines or apparatuses.

BACKGROUND OF INVENTION

The health benefits of exercise are well known and applicable to all ages of individuals, including cardiovascular improvement, muscle strengthening, stretching, increased blood circulation, better coordination, sharper motor abilities, flexible joint mobility, bone health, general overall wellness, and the like. One problem as an individual typically moves from being a child to being an adult is that physical activity levels decline just when maintaining good health is at its most important. As an individual ages, typically their exercise levels decline, which can work against maintaining good health; thus just when an individual needs to be exercising and increasing activity, their exercise and activity levels tend to decrease. Children are normally active in going places (i.e. walking or riding a bike), playing active games in their spare time, such as football, soccer, baseball, tag, hide and seek, and the like. In addition, children are generally active in physical education classes at school and many participate in after school hour's sports leagues. Thus, as children we are normally plenty active and in the best of health due to our young age. However, as we become adults, societal norms tend to drive us into a much more sedentary lifestyle, for instance by having a car, we tend to walk or ride a bicycle very little, and as an office worker, we tend to sit at a desk for long periods of time, sit in meetings, sit on airplanes, and then go out for high fat and calorie content meals at high end restaurants; thus as a result most adults tend to gain weight as they age over time by consuming more calories coupled with a lower activity lifestyle. Therefore, we typically find ourselves in worse shape just when our bodies need to be in better shape to compensate for aging.

Although the benefits of exercise, especially for adults, are acknowledged by most everyone for weight control, agility maintenance, diabetes prevention, preventing joint strain from excessive body weight, preventing higher various internal organ workloads (especially the heart) from excessive body weight, and so on, few adults are active enough to maintain even a recommended weight. Typically only about one-fourth of the adult population is not overweight in the United States. So the question to ask is why don't the majority of adults exercise, especially when the health benefits are so widely known? One probable answer is that available time and convenience are a problem for engaging in an exercise program, as most adults have a full time job, a family, and other interests that together consume most of an adults time. Thus, a potentially helpful solution is to maximize exercise efficiency, which would in turn minimize the time necessary for an adult to set aside for an exercise program, as well as maximizing convenience to allow for more exercise to be completed in less time, making regular consistent exercise more of a real possibility for a working adult.

There are three main categories of exercise—flexibility, aerobic, and anaerobic. Each of these categories is important to the well being of the human body for different reasons. Flexibility increases the range of motion for joints and muscles. Aerobic exercise increases cardiovascular health, while anaerobic exercise increases short-term muscle strength. Anaerobic exercise typically consists of weight training. The two main forms of equipment used in weight training are free weights and exercise machines. Both types of weight training equipment use gravity as the primary means of resistance. Free weights, which consist of a bar combined with variable weight plates, can be effectively used to strengthen any part of the body. However, a person must be trained in numerous exercises using free weights to be able to effectively use them for overall body strengthening. Free weights are also somewhat dangerous if the weight plates are not attached to the bar correctly. In contrast, weight machines consist of either stacked weight, which can be used in varying combinations to create variable resistance, or weight plates which a user places on the machine in the combination they feel comfortable with. Weight machines are generally safer to use than free weights due to the greater stability of the weights, but are generally limited in the type of exercises a user can perform on a single piece of equipment utilizing a single motion.

Weight machines vary greatly, from simple machines that allow performance of a single exercise to complex machines that allow performance of multiple exercises. Generally, due to the fixed nature of the weight machine apparatus, even on machines that allow performance of multiple exercises, each individual exercise works only one specific set of muscles through single axis motion. Several machines have been designed to either try to increase the amount of resistance or increase the range of motion the muscles can move through, therefore increasing the amount of work a user must do in a single exercise, which would in turn, increase the benefits to the user.

In starting a review of the prior art in this area an early device designed to operate in a different dimension than traditional exercise machines is disclosed in U.S. Pat. No. 4,720,096 to Rogers, a variation on a traditional bench press exerciser. In a traditional bench press, a load is placed on a bar and the bar is alternately raised and lowered by a user's arms, allowing for limited motion of the arm muscles throughout the exercise. To offer resistance in a different plane, Rogers' invention adds a pivot between either ends of a u-shaped bar with a spring incorporated into the pivot to provide resistance in a lateral direction. In Roger's, a weight plate can be added to either end of the u-shaped bar to offer increased resistance, however, there is no independent exercise movement resistance between the bench press type movement and the lateral movement. In addition, with the use of a spring in Roger's for lateral exercise movement resistance is not ideal as there is no real movement resistance adjustment and due to the progressive nature of spring resistance with movement i.e. the typical spring rating of pounds force per inch of movement results in uncontrolled increases in lateral movement resistance as the levers are moved progressively inward.

Continuing, in the prior art of multi axes exercise equipment in looking at U.S. Pat. No. 5,643,152 to Simonson, a weight machine is disclosed to allow for both lateral and upward resistance. In Simonson '152, a double-hinge mechanism is incorporated to allow for dual direction resistance on a stacked weights machine using belt linkages on an eccentric cam and numerous pulleys to communicate the variable weight stack gravitational force to the upward resistance only, however, the lateral resistance is a fixed pivot resistance that has no communication with the stacked weights, being somewhat similar in function to Roger's. Simonson's '152 invention allows for the user to vary the distance between their hands while performing chest press exercises as a distinction to a conventional chest press exercise machine, and further allows for selection of the path of hand motion best suited to a user's anatomy. Simonson's '152 invention, however, does not allow for separate resistance weight training laterally and longitudinally, but rather only teaches variable resistance in the upward exercise movement only allowing a fixed weight movement resistance in the lateral direction.

Next to the same inventor, in U.S. Pat. No. 5,788,614 to Simonson, another weight machine is disclosed that offers both lateral and longitudinal resistance in only a fixed angular axis of movement, reference pivots 32 and 34 along with weight plate holders 62, all as shown in FIG. 1. Thus, Simonson '614 discloses a plate loaded weight machine partially similar to Simonson '152, the major difference being the use of weight plates for direct bar resistance instead of the stacked weights that communicate through belt linkages and pulleys that are incorporated in Simonson '152. In summary for the Simonson '614 reference, as in Simonson '152, the chest press exercise movement there can be simultaneous lateral and upward movement, however, as the Simonson '614 reference has weight plates stacked directly upon the movement arm, see FIG. 6, the weight resistance between the lateral and upward movement has a fixed relationship thus there is no teaching of independent, double axes separately selectable resistance as between the lateral and upward movements.

Further, in the multi axes exercise machine prior art looking at U.S. Pat. No. 6,358,189 to Koenig, a weight machine specifically targeting the upper extremities of the body is disclosed having a limited omni-directional allowance of movement of the extension arm. Koenig employs a pivotal yoke mechanism for various movements of the fixed weight load as best shown in FIG. 4 with the weight plate 9 on support rod 54. However, functionally as above in Simonson '614, Simonson '152, and Roger's the weight loads or amount of exercise movement resistance in Koenig is not separated for lateral and upward motion, thus the omni-directional resistance is fixed by weight plate 9 as shown in FIG. 4. Thus, to summarize in Koenig, there is taught motion in multiple directions, but the weight load is fixed for each directions as the resistance loading is based upon only a single set of plate weights as in Simonson '614 and Simonson '152, as Roger's uses a spring resulting in non independent nor variable resistance force in each of the movement axes.

Continuing in a similar manner, further in the prior art for multi-axes exercise machines, another such machine is seen in U.S. Pat. No. 6,482,135 to Ish, III et al, that has a non resistance pivoting weight plate stack that facilitates resistance movement along an arc 116, see FIG. 7 for an example. Thus in Ish, III et al., a weight machine with a moveable load guide is disclosed. The movement of the load guide necessitates that the user of Ish, III et al.'s machine maintain balance of the load which freely pivots laterally, again see FIG. 7, somewhat simulating a free weight situation wherein a user must laterally stabilize the weight, which necessitates additional muscular effort, which would lead to providing an enhanced workout, exercising more of the user's upper body. The load guide in Ish, III et al. includes a rocker which is engagable with either the floor or a support system. As a user in Ish, III et al., exerts a force to the lift member in order to overcome the gravitational pull of the load, the load is at least partially balanced laterally within the load guide by the user, if a support system is used, it could be pivotal in either a single plane of freedom or in two planes of freedom. While in Ish, III et al., the user balancing load system may slightly enhance the effectiveness of a workout, it does not specifically target or specifically teach variable selectable independent resistance in the lateral direction, in combination with selectable independent variable resistance in an upper direction in a single exercise machine.

The prior art in the field of weight machines does recognize the need for multi-axes weight training resistance movement for enhanced muscle training, or in other words for requiring added muscles to be used during a workout session having the attendant benefit of combining multiple exercises into the span of time that normally a single exercise takes, resulting in a more efficient workout. However, there is a lack of recognition for multi axes movement having variable independent selectable resistance in more than one axis simultaneously. Wherein the prior art will facilitate multiple axes exercise movement being only typically with a single resistance mass or cable/flexible strap arrangement, thus even though the prior art exercise machine arm movement is in an angled arc movement, there is still only a single resistance with the single mass or cable/strap force resulting in a limited exercise, i.e. the vertical and horizontal resistance through the arm movement are in a fixed and unchangeable relationship, as is the angular movement of the exercise arm in a totally fixed arrangement. What is needed is a weight machine having the capability to create independent selectable variable resistance for each axis of movement simultaneously, thereby allowing optimization of different resistance loads placed upon different muscles at the same time while the user is completing a single exercise motion, similar to free weights, thus further enhancing exercise efficiency while at the same time maintaining the benefit of an exercise machine, namely safety from the hazards of free weights that are well known.

The present invention exercise apparatus with independently variable multiple axes movement with independent selectable resistance or loading of muscles in at least two simultaneous planes of resistance allows the exercise machine user to maximize the workout of all divisions of a muscle, for example the costal, sternal, and clavicular fibers of the pectoralis major in a single motion, thus increasing workout efficiency resulting in a shorter (time-wise) more effective workout. Furthermore, the present invention exercise apparatus while not having the safety drawbacks of free weights, works towards eliminating the exercise movement limitations of exercise machines by facilitating simultaneous multiple axes exercise resistance movement that is an inherent benefit of free weights, however, with the multi axes weight machine being in a controlled environment to allow one of the benefits of free weights of multiple axes resistance movement with the added enhancement of different resistances available in each axis of exercise movement. Thus, the result here in a sense is in combining the best of free weights and the best of exercise machines minus the downsides of both the free weights for safety issues and also minus the downsides of exercise machines typically being the single limiting axis of exercise movement limitation or singular non independent resistance load for multiple axes exercise movements.

SUMMARY OF INVENTION

The present invention is a multi-axes exercise apparatus to further enhance the movement of the selectable weight resistance load in more than one direction simultaneously. Broadly, the present invention of an exercise apparatus includes a base structure, a multiple axes pivotal mechanism disposed adjacent to the base structure, and an arm. The arm further includes a distal end portion and a proximal end portion with a longitudinal axis spanning therebetween. The distal and proximal end portions are each adapted to provide independent resistive force to muscle exertion, with the proximal end portion being adjacent to the mechanism such that operationally at least two independent axes of movement occur in the arm relative to the structure. Also included in the exercise apparatus is an assemblage for creating selectable variable resistance forces to the movement of the arm relative to the structure, such that each axis of movement has an independent selectable variable resistance force to the arm movement.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
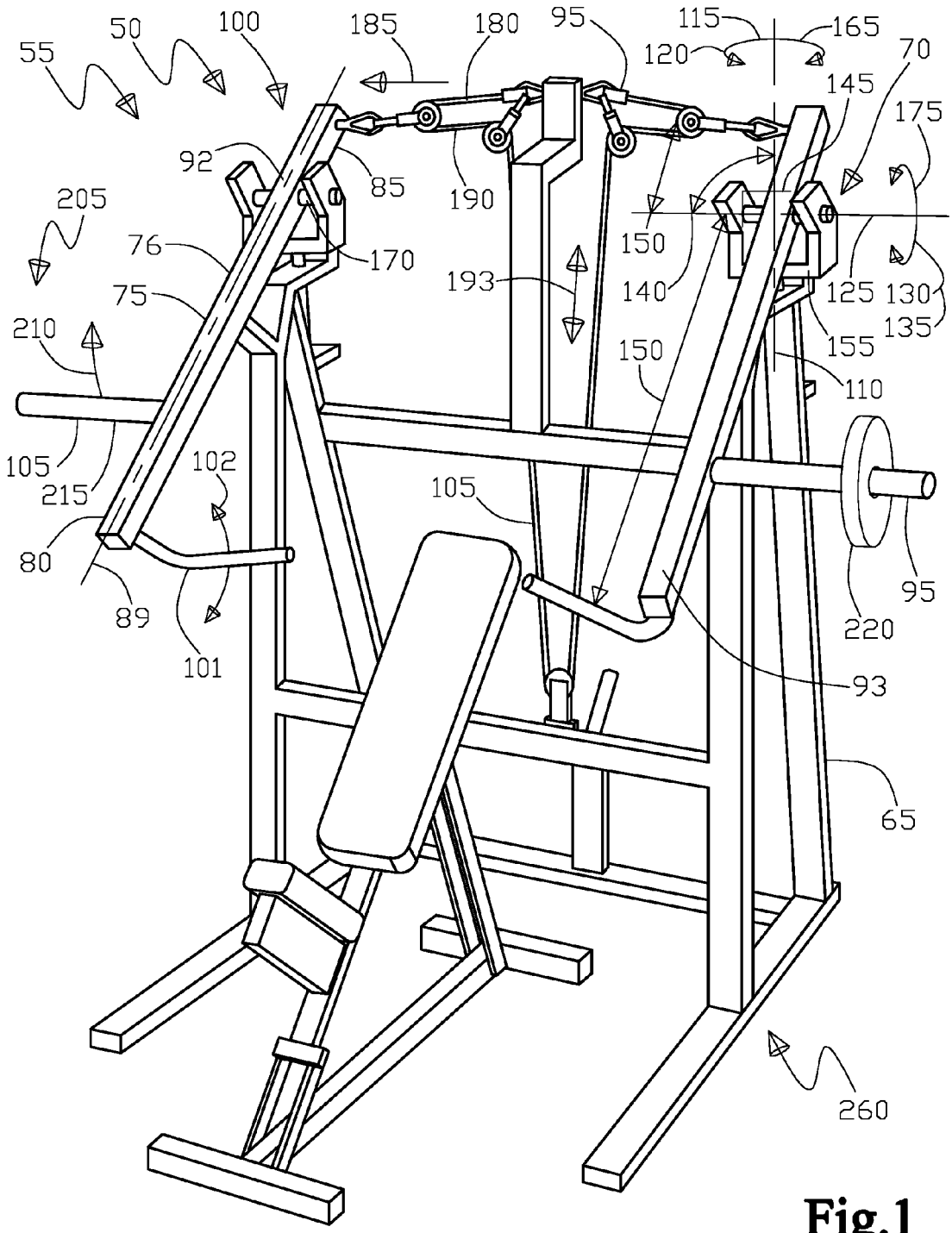
FIG. 1 shows a perspective view of the exercise apparatus, being specifically the chest embodiment in the at rest positional state from the user's side.

50 Exercise apparatus
55 Exercise apparatus chest embodiment
60 Exercise apparatus back embodiment
61 Exercise apparatus chest and back embodiments combined
65 Base structure
70 Multiple axis pivotal mechanism
75 Arm
76 Arm for chest embodiment 55
77 Arm for back embodiment 60
78 Arm for chest and back embodiments combined 61
80 Distal end portion of arm 75, 76, 77, or 78
85 Proximal end portion of arm 75, 76, 77, or 78
89 Longitudinal axis of arm 75, 76, or 77
90 Longitudinal axis of arm 78
91 Lat pull down end portion of arm 77
92 Intermediate portion of arm 75, 76, 77, or 78
93 Bench push up end portion of arm 76
95 Independent resistive forces to muscle exertion by distal 80 and proximal 85 end portions
100 Independent axes of movement in the arm 75, 76, 77, or 78 relative to the structure 65
101 Handle for arm 75, 76, 77, or 78
102 Pivotal movement of handle 101
105 Means for creating independently selectable variable resistance forces
110 First axis
115 Pivotal rotation of arm 75, 76, 77, or 78 proximal end portion 85 about the first axis 110
120 First rotational arc of movement resistance
125 Second axis
130 Pivotal rotation of arm 75, 76, 77, or 78 proximal end portion 85 about the second axis 125
135 Second rotational arc of movement resistance
140 Substantially perpendicular orientation of the first axis 110 to the second axis 125
145 Single plane positioning of the first axis 110 and the second axis 125
150 Substantially constant moment arm distance along the longitudinal axis 90
155 Yoke element of the mechanism 70
160 Pivotal attachment of the yoke element 155 to the structure 65 about the first axis 110
165 Pivotal movement of pivotal attachment 160
170 Pivotal attachment of the proximal end portion 85 to the yoke 155 about the second axis 125
175 Pivotal movement of pivotal attachment 170
180 First assemblage
185 First selected resistance movement of first assemblage 180
190 Flexible component of the first assemblage 180
191 Movement arc of arm 75, 76, 77, or 78 in relation to first assemblage 180 for movement 185
195 Communication of movement of the flexible component 190
200 First selected weight plate of first assemblage 180 movably disposed on the structure 65
205 Second assemblage
210 Second selected resistance movement of second assemblage 205
215 Retainer extension of second assemblage 205
220 Second selected weight plate that removably engages the retainer extension 215
225 User
226 Chest user
227 Back user
230 Anatomy of the user 225
235 Attaching a portion of a user's anatomy to the distal end portion 80
240 Moving the distal end portion 80 by the user 225 in a first rotational arc movement 245 Moving the distal end portion 80 by the user 225 in a second rotational arc movement
250 Single combined motion of movement 240 and movement 245
260 At rest positional state of the chest embodiment 55 of the exercise apparatus 50
261 At rest positional state of the back embodiment 60 of the exercise apparatus 50
262 At rest positional state of the combined chest and back embodiment 61 of the exercise apparatus 50

265 Extended positional state with movement about the second axis 125 of the chest embodiment 55 of the exercise apparatus 50

266 Extended positional state with movement about the second axis 125 of the back embodiment 60 of the exercise apparatus 50

267 Extended positional state with movement about the second axis 125 of the combined chest and back embodiment 61 of the exercise apparatus 50

270 Extended positional state with movement about the first 110 and second 125 axes of the chest embodiment 55 of the exercise apparatus 50

271 Extended positional state with movement about the first 110 and second 125 axes of the back embodiment 60 of the exercise apparatus 50

272 Extended positional state with movement about the first 110 and second 125 axes of the combined chest and back embodiment 61

DETAILED DESCRIPTION

Figure 2:
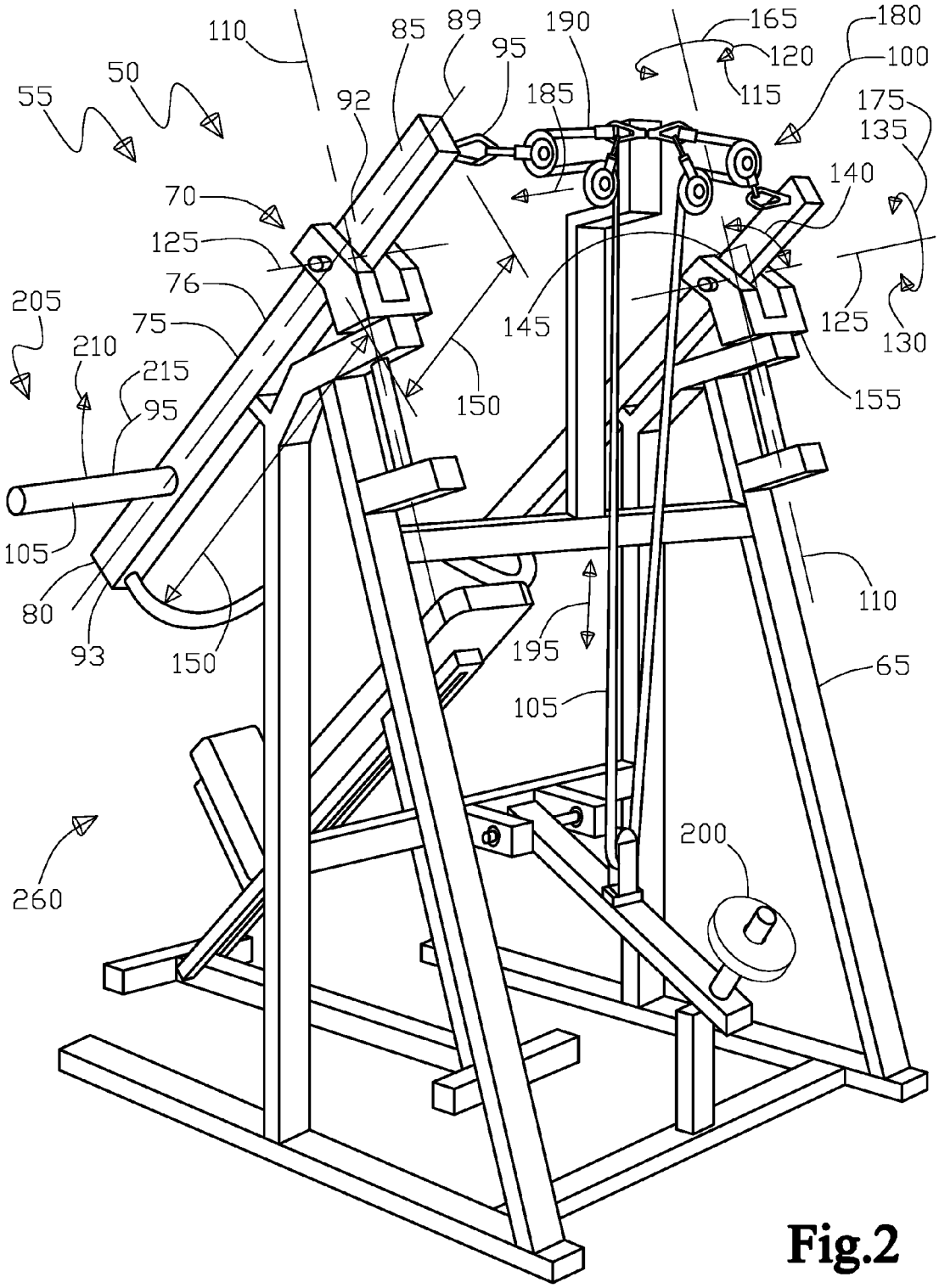
FIG. 2 shows a perspective view of the exercise apparatus, being specifically the chest embodiment in the at rest positional state from opposite of the user's side.
Figure 3:
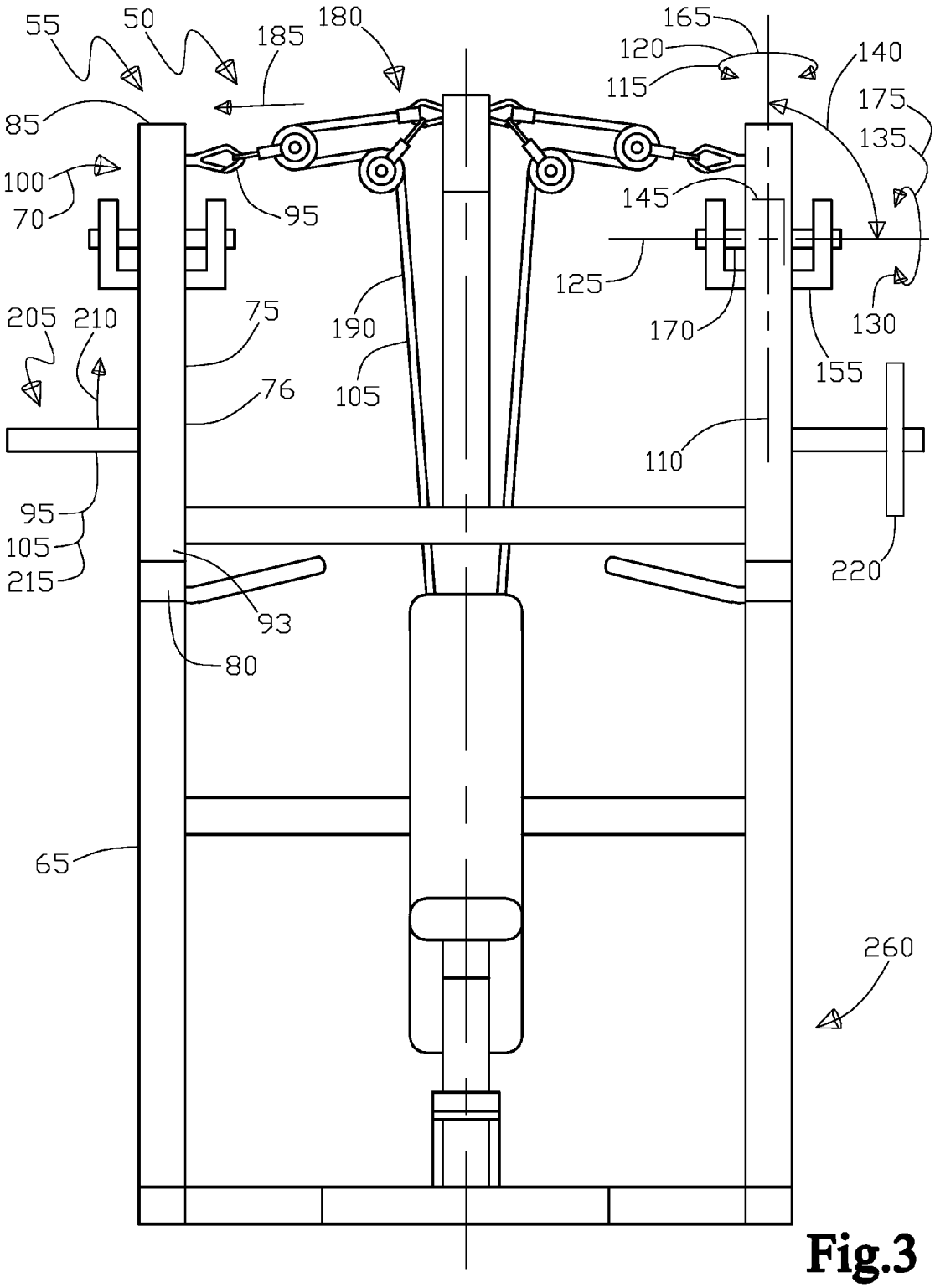
FIG. 3 shows a user side elevation view of the exercise apparatus, being specifically the chest embodiment in the at rest positional state.
Figure 4:
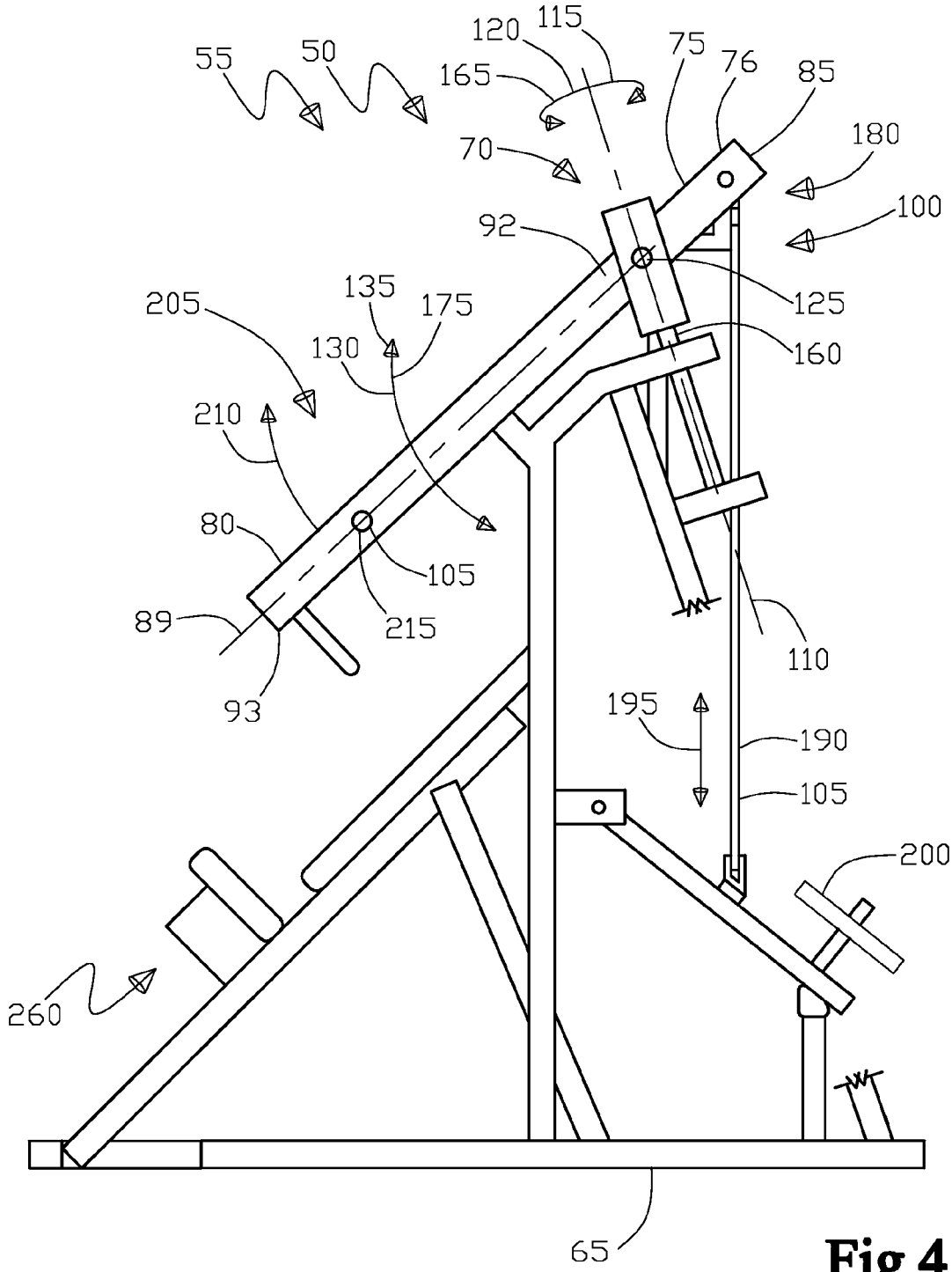
FIG. 4 shows a side elevation view of the exercise apparatus, being specifically the chest embodiment in the at rest positional state.
Figure 5:
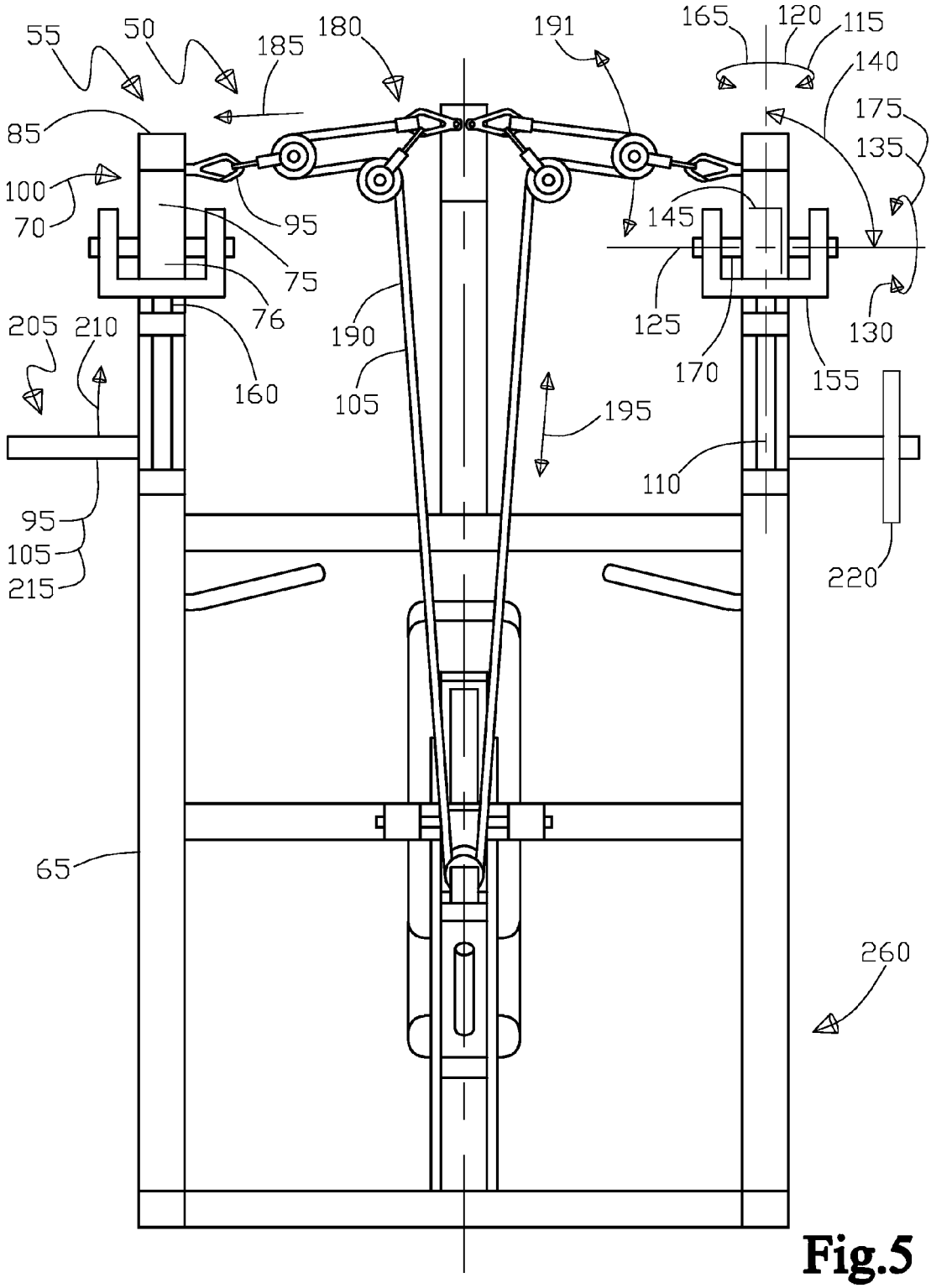
FIG. 5 shows a side elevation view opposite of the user of the exercise apparatus, being specifically the chest embodiment in the at rest positional state.
Figure 6:
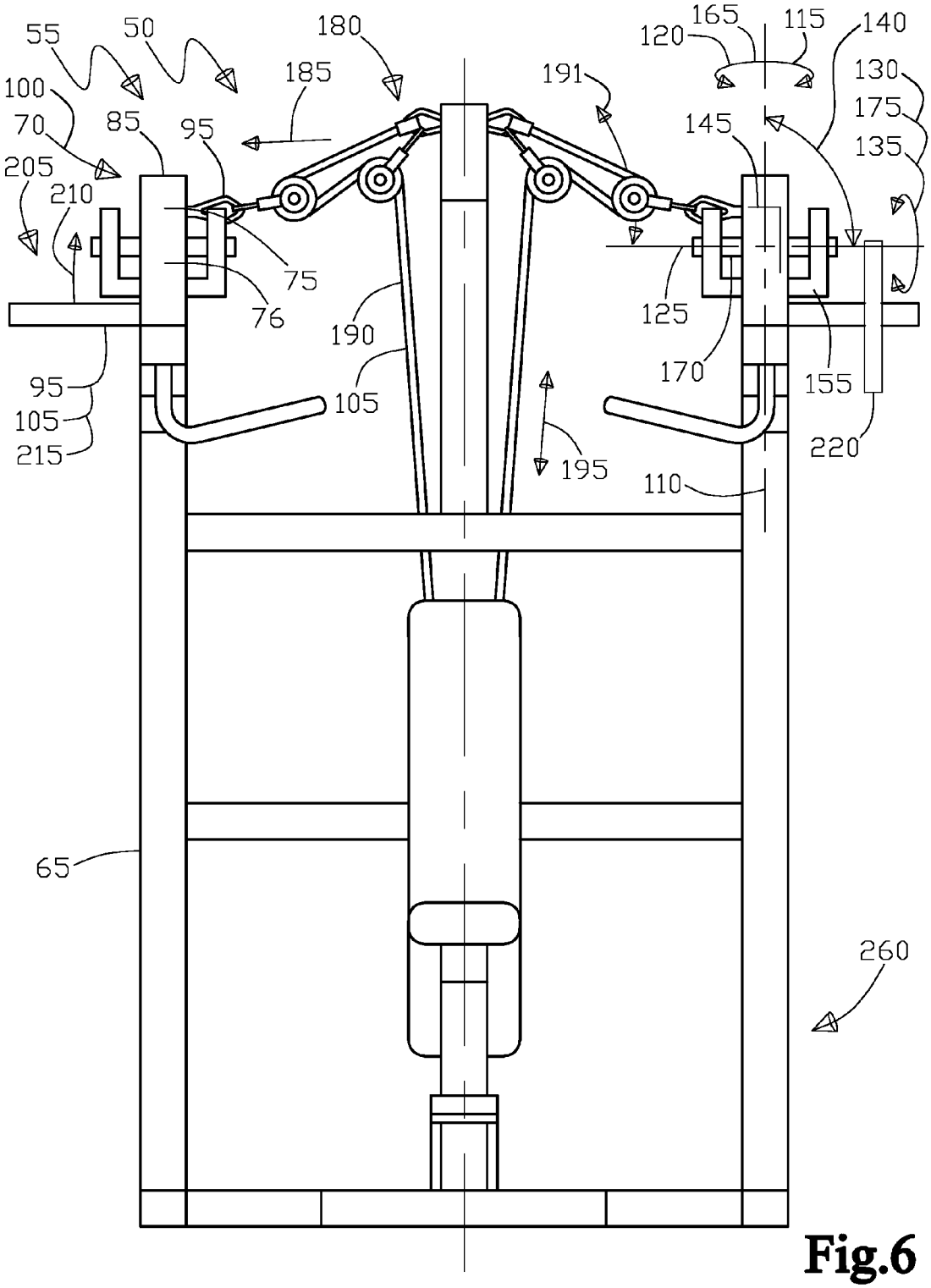
FIG. 6 shows a user side elevation view of the exercise apparatus, being specifically the chest embodiment in the extended positional state with movement in the second rotational arc being about the second axis from the at rest positional state.

With initial reference to FIG. 1 shown is a perspective view of the exercise apparatus 50, being specifically the chest embodiment 55 in the at rest 260 positional state from the user's 225 and 226 side and FIG. 2 also shows a perspective view of the exercise apparatus 50, being specifically the chest embodiment 55 in the at rest 260 positional state from opposite of the user's 225 and 226 side. Further, FIG. 3 shows a user 225 and 226 side elevation view of the exercise apparatus 50, being specifically the chest embodiment 55 in the at rest 260 positional state and FIG. 4 shows a side elevation view of the exercise apparatus 50, being specifically the chest embodiment 55 in the at rest 260 positional state. Continuing, FIG. 5 shows a side elevation view opposite of the user 225, 226 of the exercise apparatus 50, being specifically the chest embodiment 55 in the at rest 260 positional state and FIG. 6 shows a user 225, 226 side elevation view of the exercise apparatus 50, being specifically the chest embodiment 55 in the extended 265 positional state with movement resistance in the second rotational arc 135 being about the second axis 125 from the at rest 260 positional state.

Figure 7:
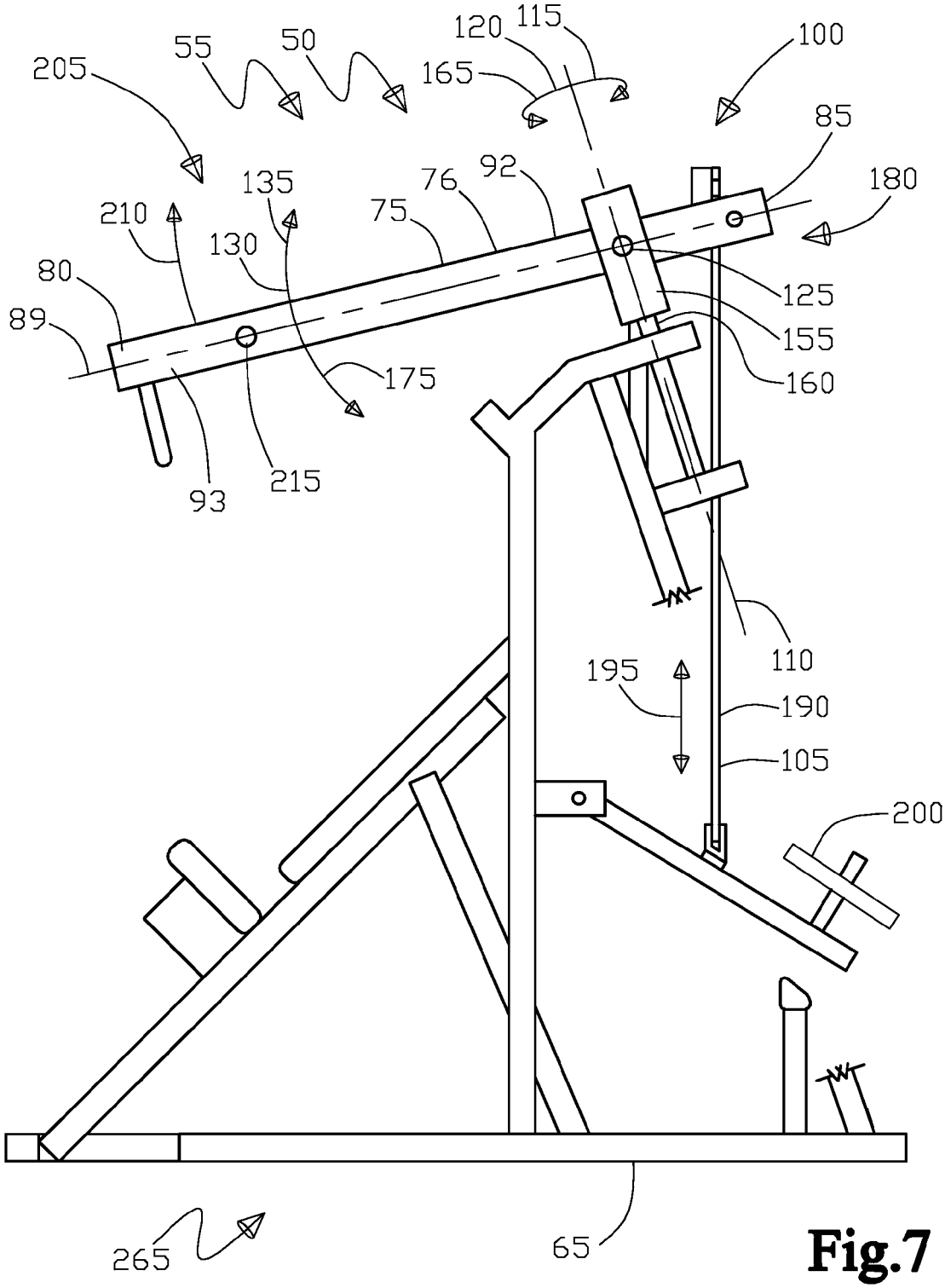
FIG. 7 shows a side elevation view of the exercise apparatus, being specifically the chest embodiment in the extended positional state with movement in the second rotational arc being about the second axis from the at rest positional state.
Figure 8:
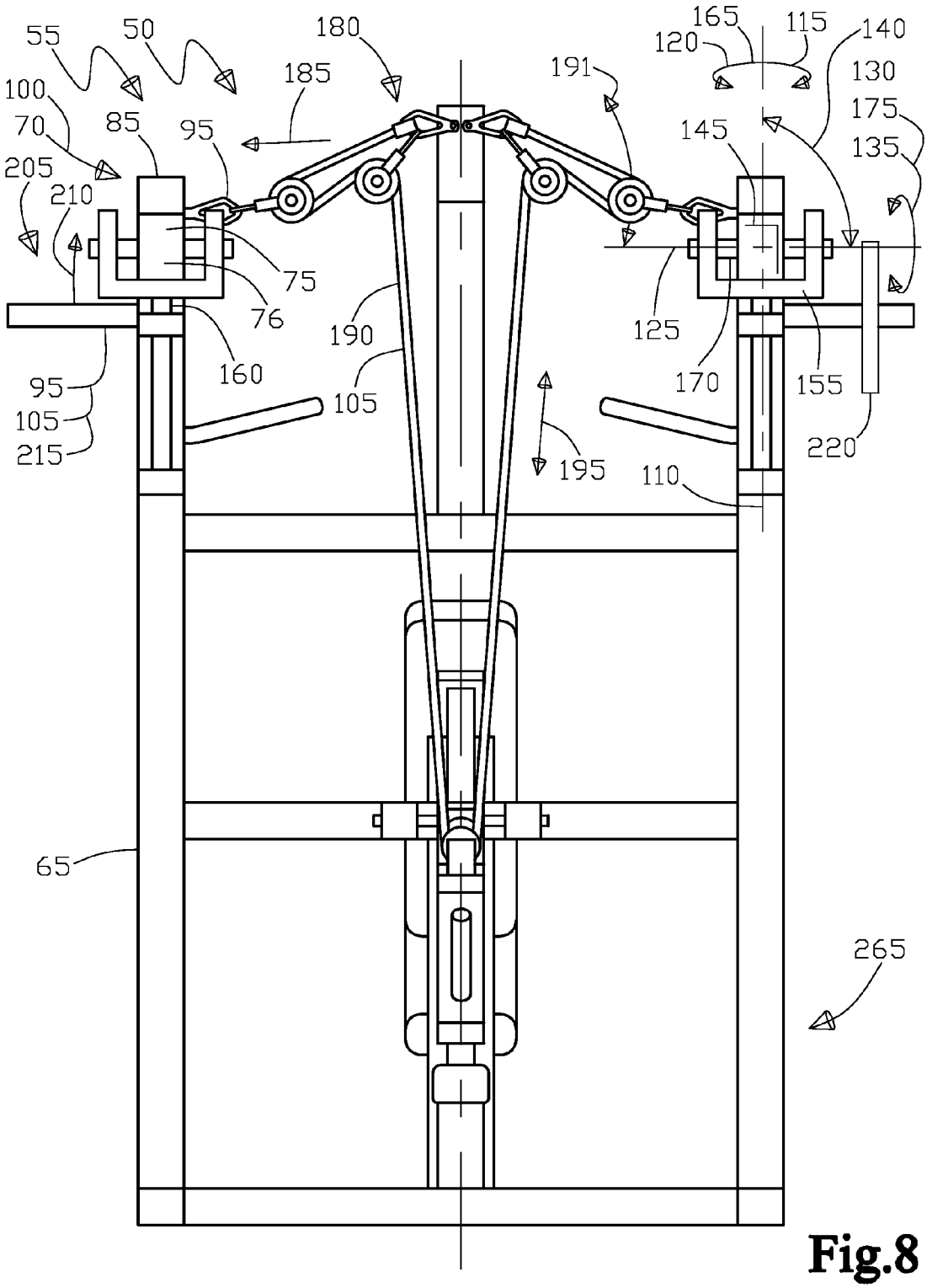
FIG. 8 shows a side elevation view opposite of the user of the exercise apparatus, being specifically the chest embodiment in the extended positional state with movement in the second rotational arc being about the second axis from the at rest positional state.
Figure 9:
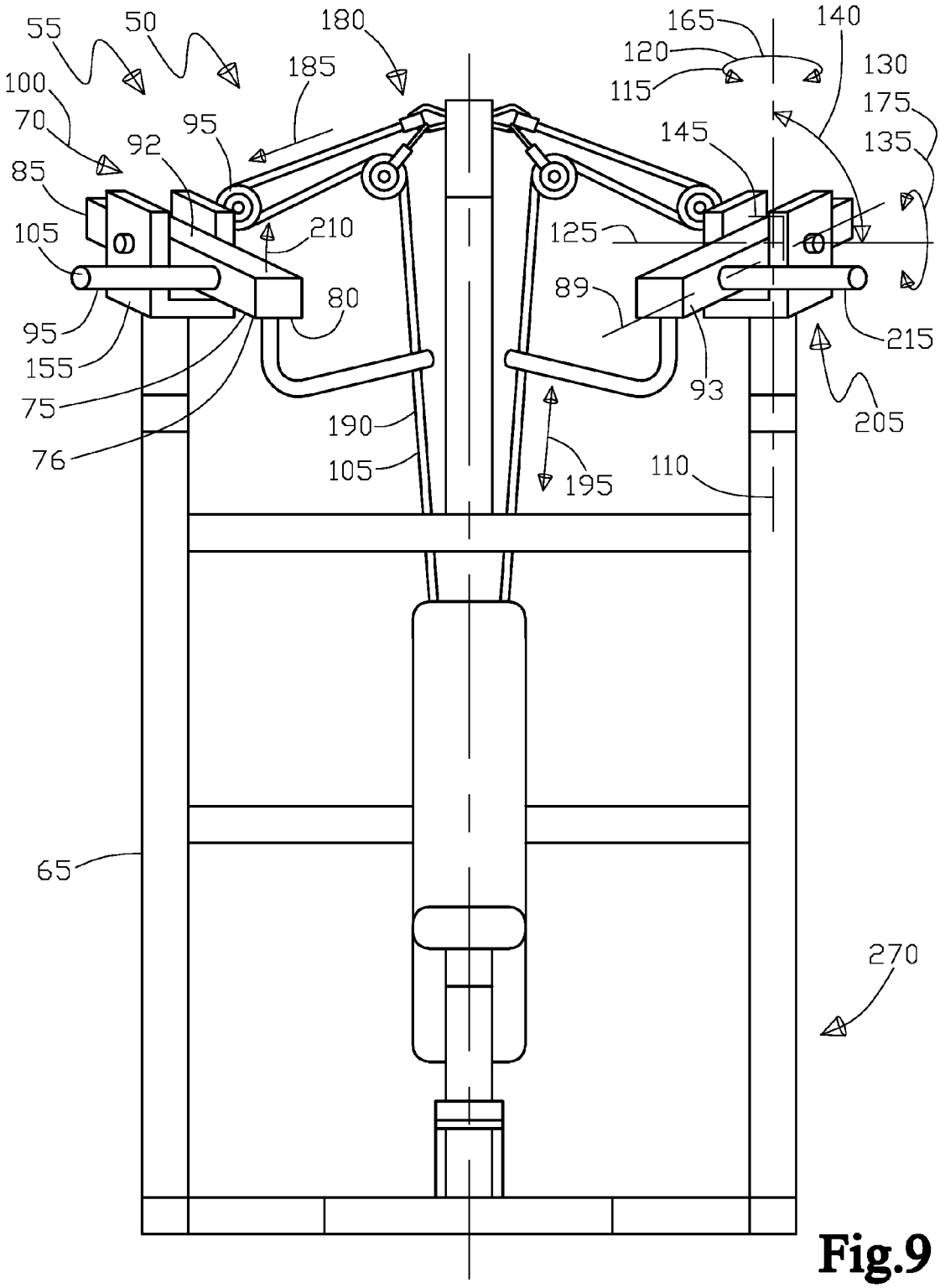
FIG. 9 shows a user side elevation view of the exercise apparatus, being specifically the chest embodiment in the extended positional state with movement in the second rotational arc being about the second axis from the at rest positional state.
Figure 10:
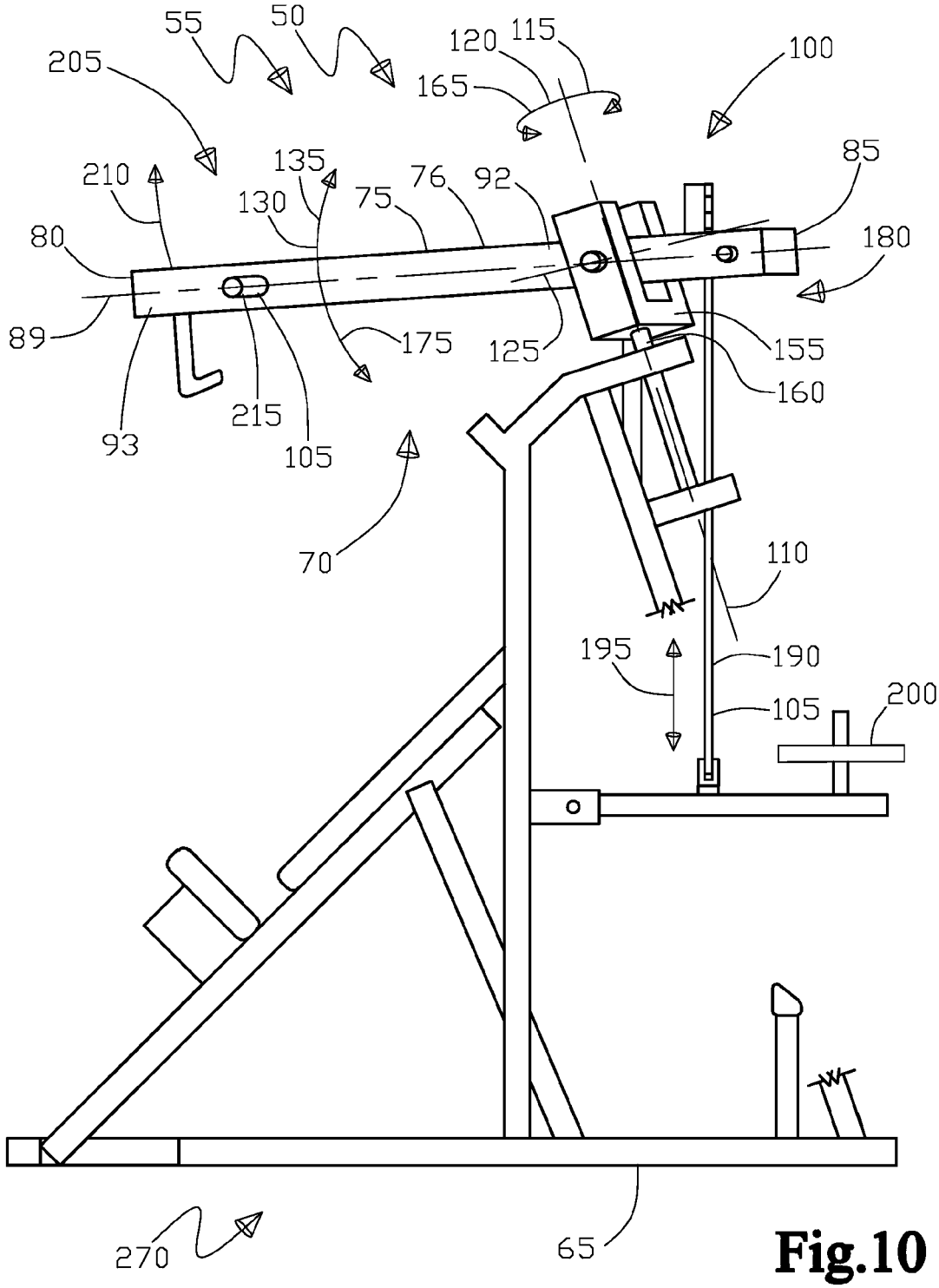
FIG. 10 shows a side elevation view of the exercise apparatus, being specifically the chest embodiment in the extended positional state with movement in the second rotational arc being about the second axis from the at rest positional state.

Next, FIG. 7 shows a side elevation view of the exercise apparatus 50, being specifically the chest embodiment 55 in the extended 265 positional state with movement resistance in the second rotational arc 135 being about the second axis 125 from the at rest 260 positional state. Moving onward, FIG. 8 shows a side elevation view opposite of the user 225, 226 of the exercise apparatus 50, being specifically the chest embodiment 55 in the extended 265 positional state with movement resistance in the second rotational arc 135 being about the second axis 125 from the at rest 260 positional state and FIG. 9 shows a user 225, 226 side elevation view of the exercise apparatus 50, being specifically the chest embodiment 55 in the extended 265 positional state with movement resistance in the second rotational arc 135 being about the second axis 125 from the at rest 260 positional state. Continuing, FIG. 10 shows a side elevation view of the exercise apparatus 50, being specifically the chest embodiment 55 in the extended 265 positional state with movement resistance in the second rotational arc 135 being about the second axis 125 from the at rest 260 positional state.

Figure 11:
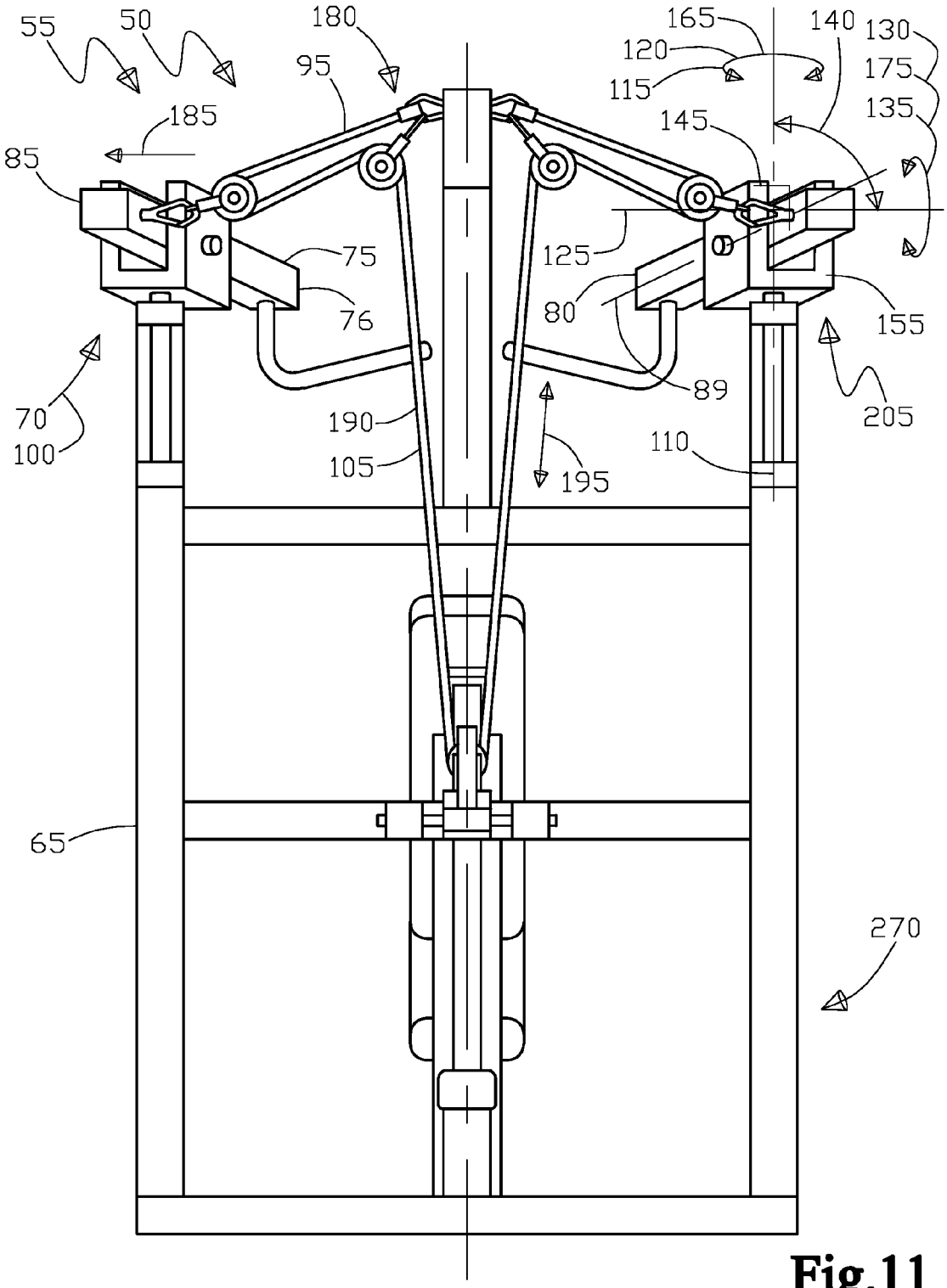
FIG. 11 shows a side elevation view opposite of the user of the exercise apparatus, being specifically the chest embodiment in the extended positional state with movement in both the first rotational arc being about the first axis and movement in the second rotational arc being about the second axis from the at rest positional state.
Figure 12:
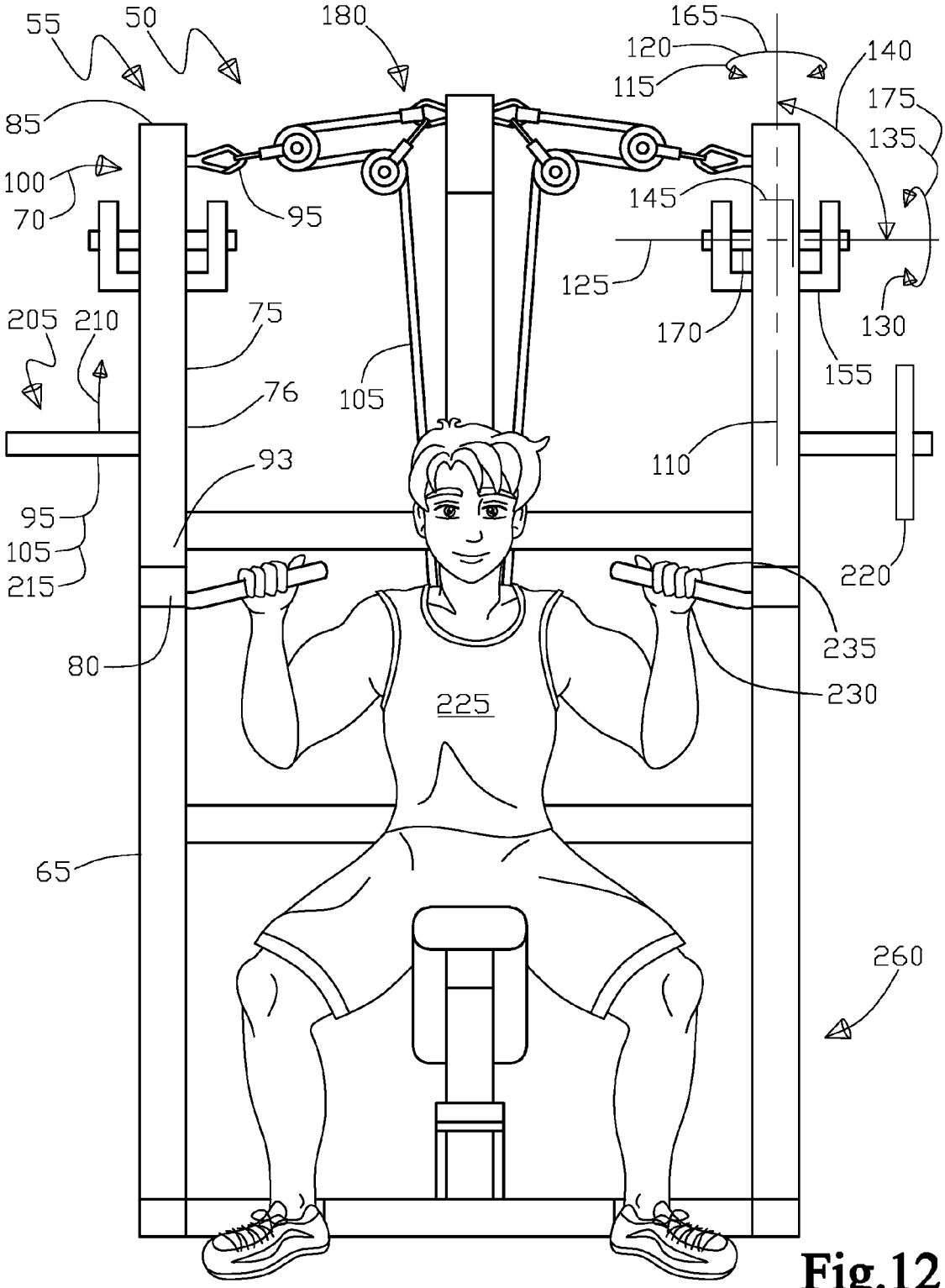
FIG. 12 shows a user side elevation view of the exercise apparatus, being specifically the chest embodiment in use in the at rest positional state.
Figure 13:
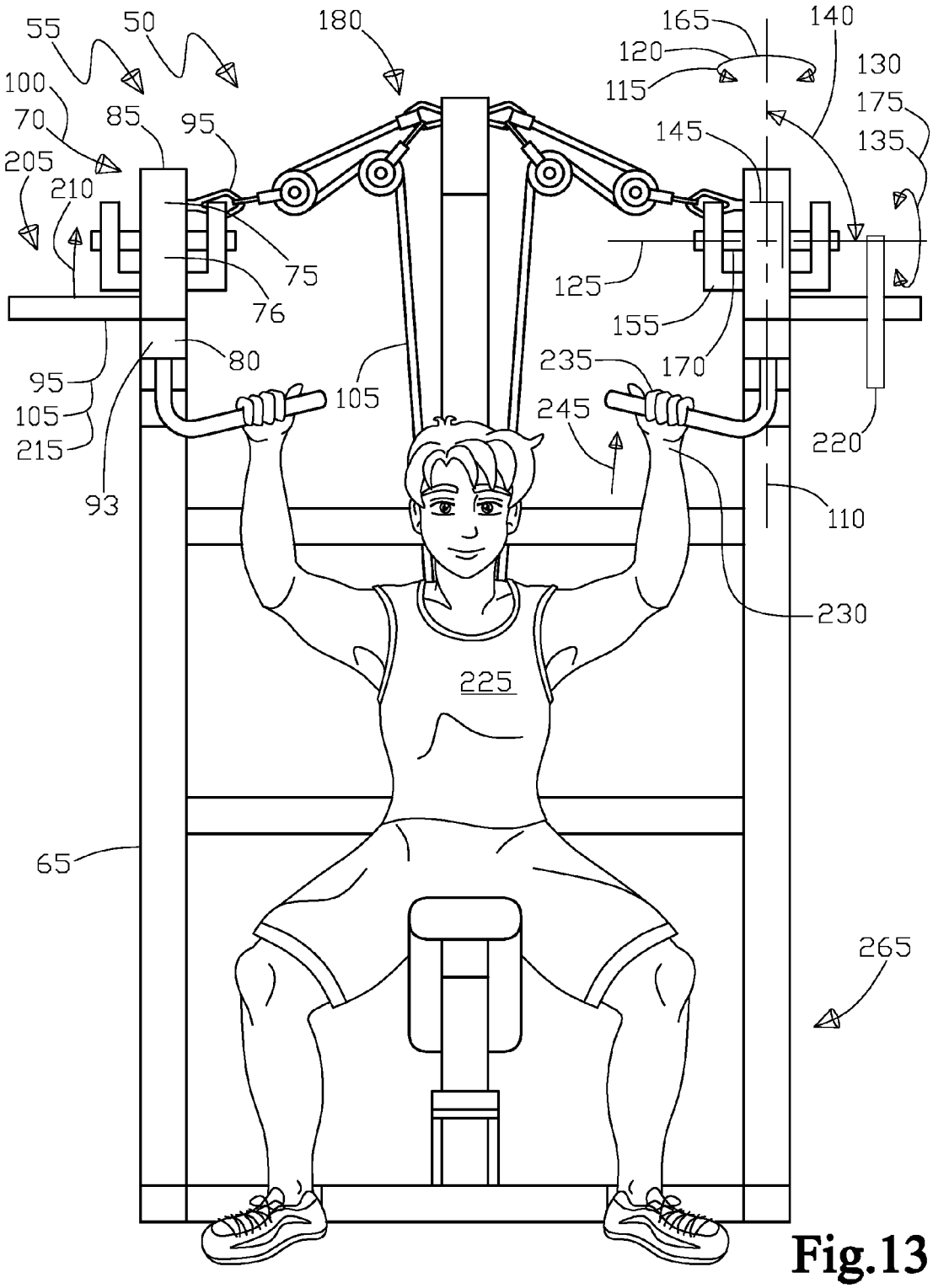
FIG. 13 shows a user side elevation view of the exercise apparatus, being specifically the chest embodiment in use in the extended positional state with movement in the second rotational arc being about the second axis from the at rest positional state.
Figure 14:
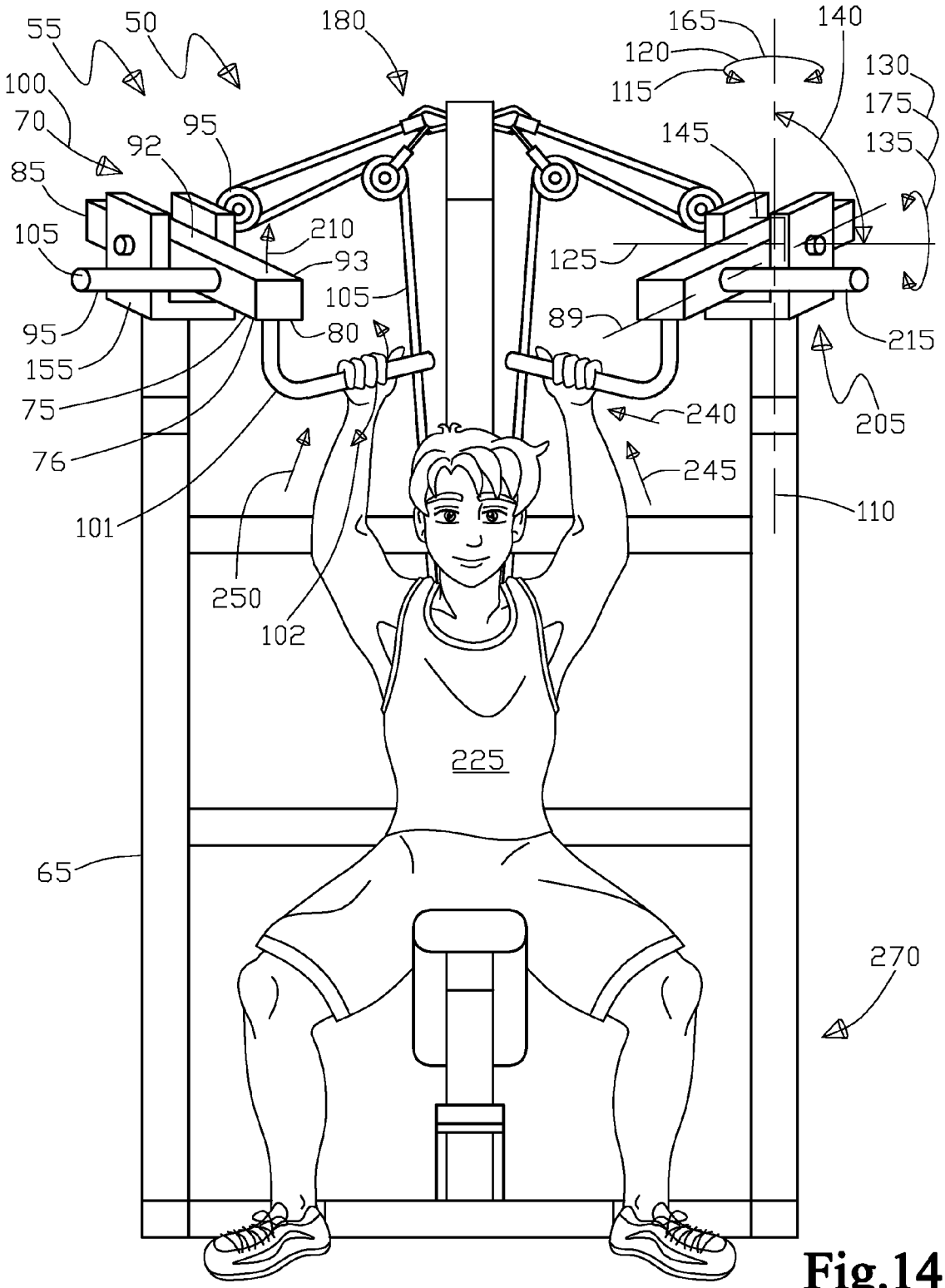
FIG. 14 shows a side elevation view from the user side in use of the exercise apparatus, being specifically the chest embodiment in the extended positional state with movement in both the first rotational arc being about the first axis and movement in the second rotational arc being about the second axis from the at rest positional state.

Moving onward, FIG. 11 shows a side elevation view opposite of the user 225, 226 of the exercise apparatus 50, being specifically the chest embodiment 55 in the extended 265 positional state with movement in both the first rotational arc of movement resistance 120 being about the first axis 110 and movement resistance in the second rotational arc 135 being about the second axis 125 from the at rest 260 positional state and FIG. 12 shows a user 225, 226 side elevation view of the exercise apparatus 50, being specifically the chest embodiment 55 in use in the at rest 260 positional state. Further, FIG. 13 shows a user 225, 226 side elevation view of the exercise apparatus 50, being specifically the chest embodiment 55 in use in the extended 265 positional state with movement resistance in the second rotational arc 135 being about the second axis 125 from the at rest 260 positional state. Next, FIG. 14 shows a side elevation view from the user 225, 226 side in use of the exercise apparatus 50, being specifically the chest embodiment 55 in the extended 265 positional state with movement in both the first rotational arc of movement resistance 120 being about the first axis 110 and movement resistance in the second rotational arc 135 being about the second axis 125 from the at rest 260 positional state.

Figure 15:
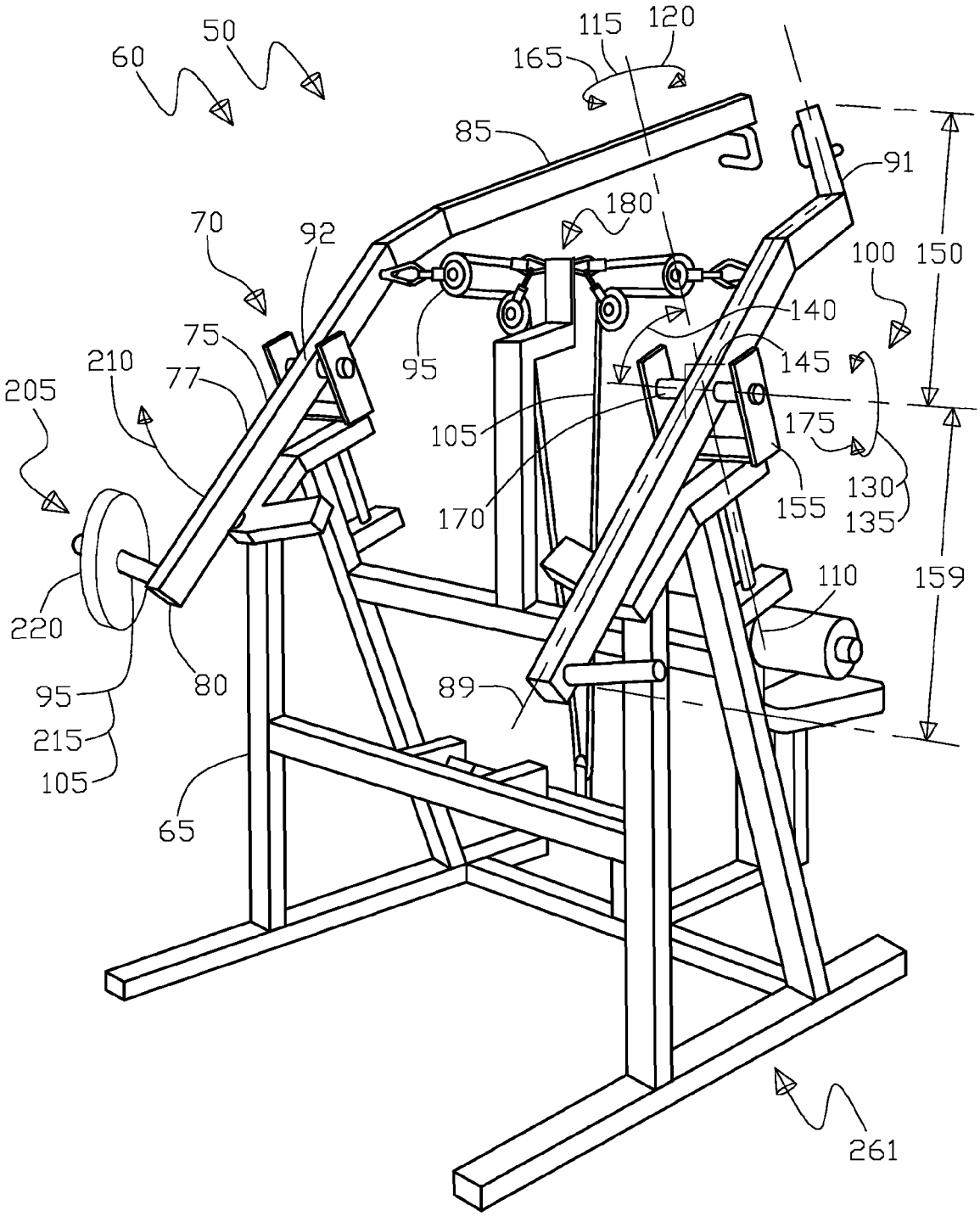
FIG. 15 shows a perspective view of the exercise apparatus, being specifically the back embodiment in the at rest positional state from opposite of the user's side.
Figure 16:
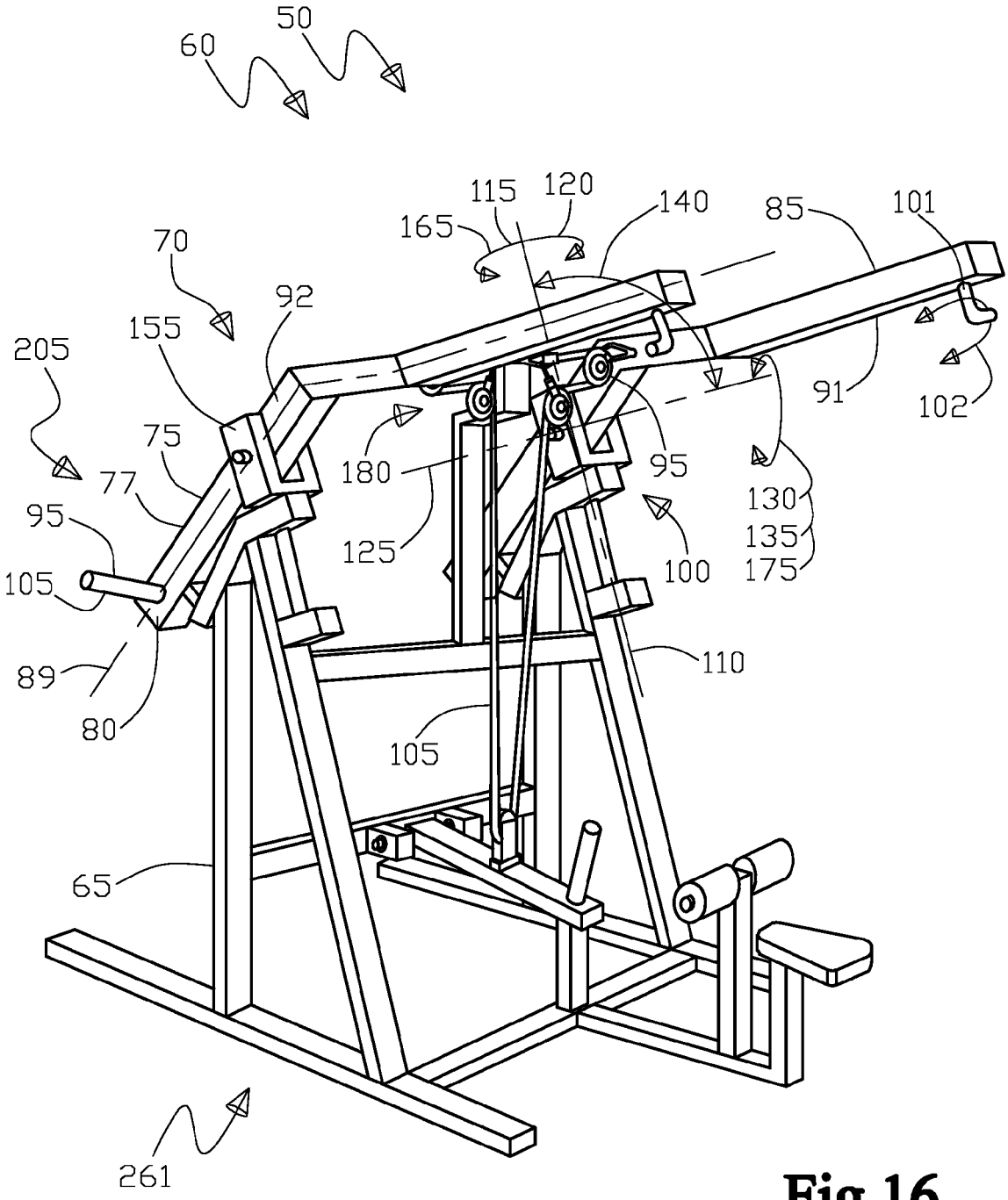
FIG. 16 shows a perspective view of the exercise apparatus, being specifically the back embodiment in the at rest positional state from the user's side.
Figure 17:
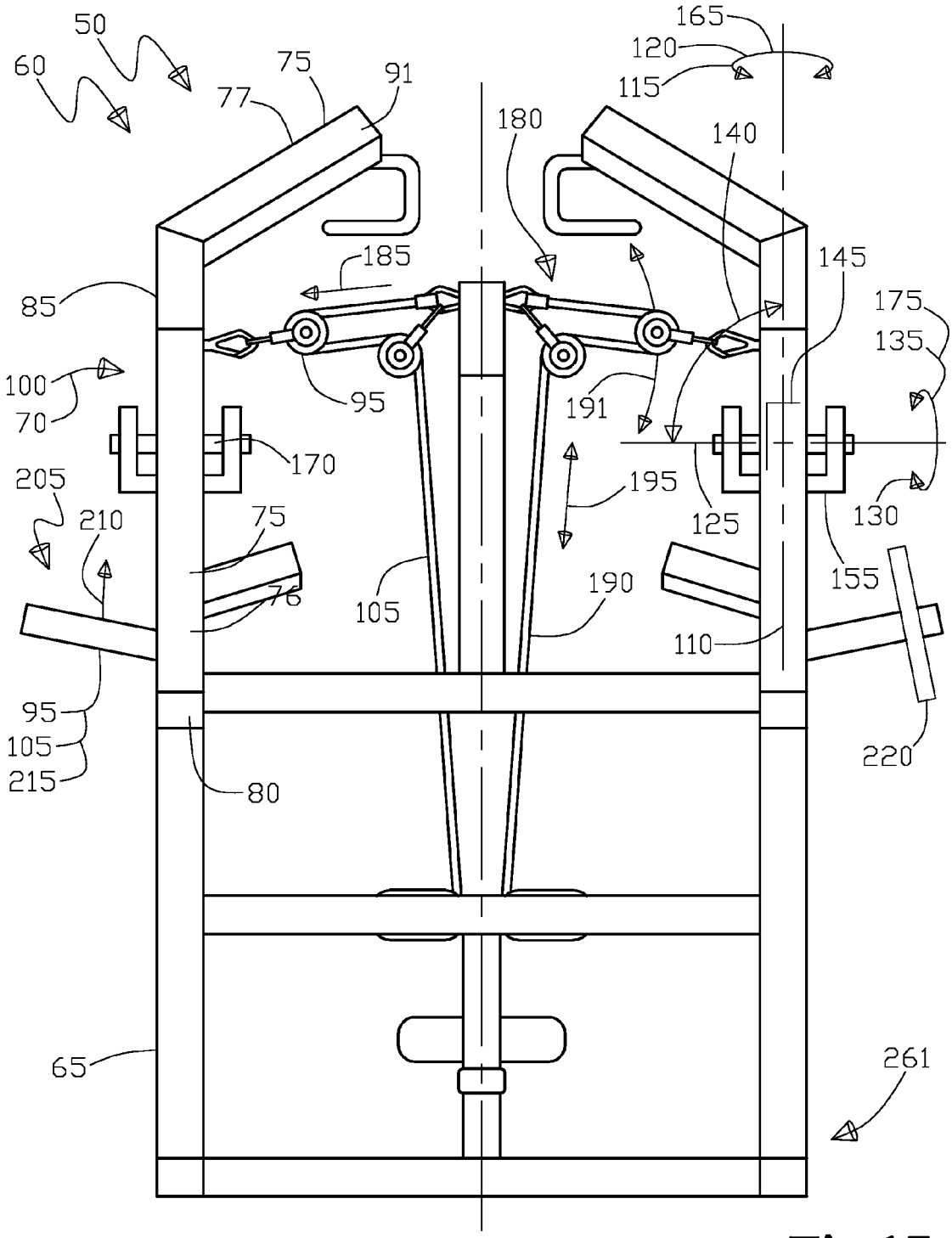
FIG. 17 shows a side elevation view opposite of the user of the exercise apparatus, being specifically the back embodiment in the at rest positional state.
Figure 18:
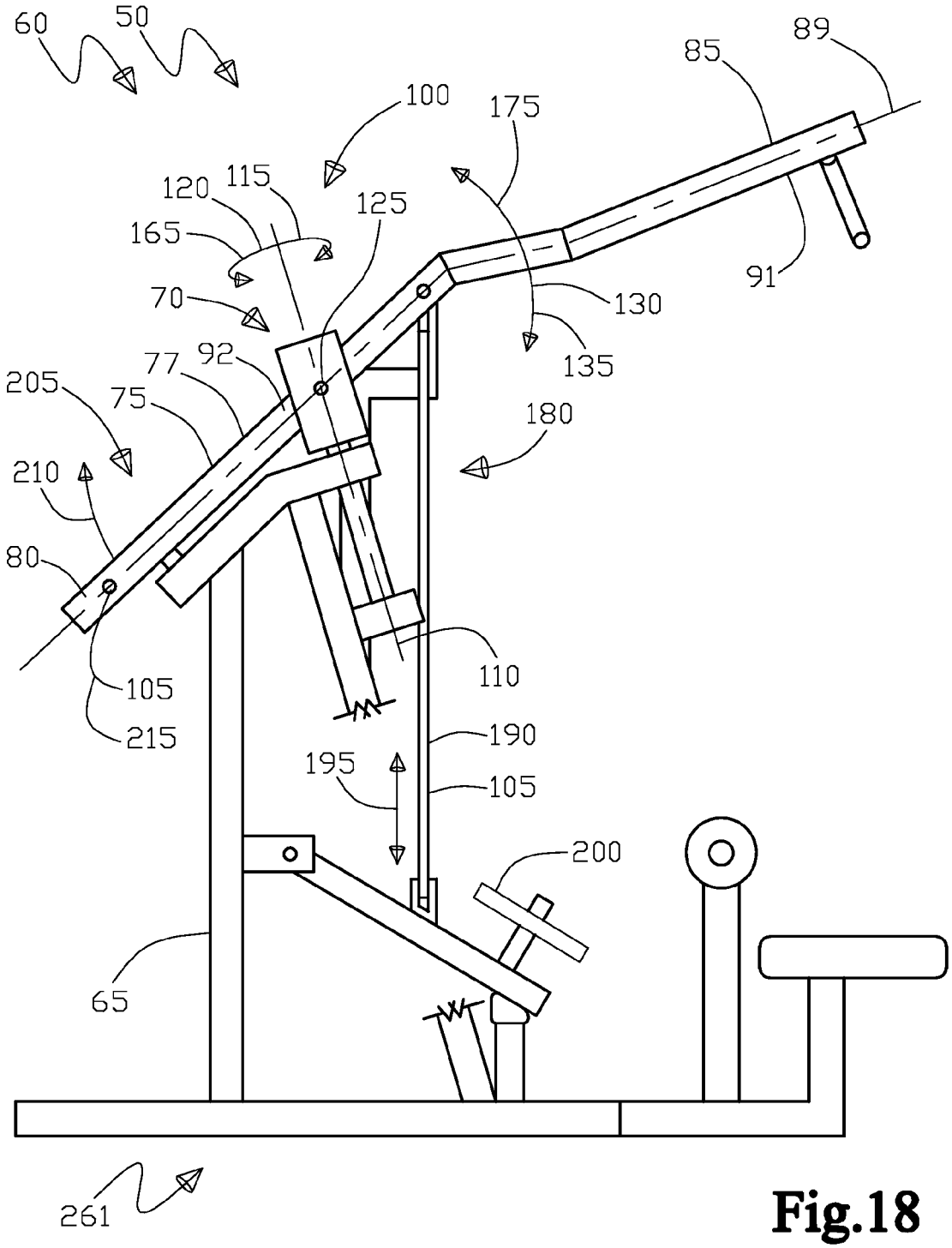
FIG. 18 shows a side elevation view of the exercise apparatus, being specifically the back embodiment in the at rest positional state.
Figure 19:
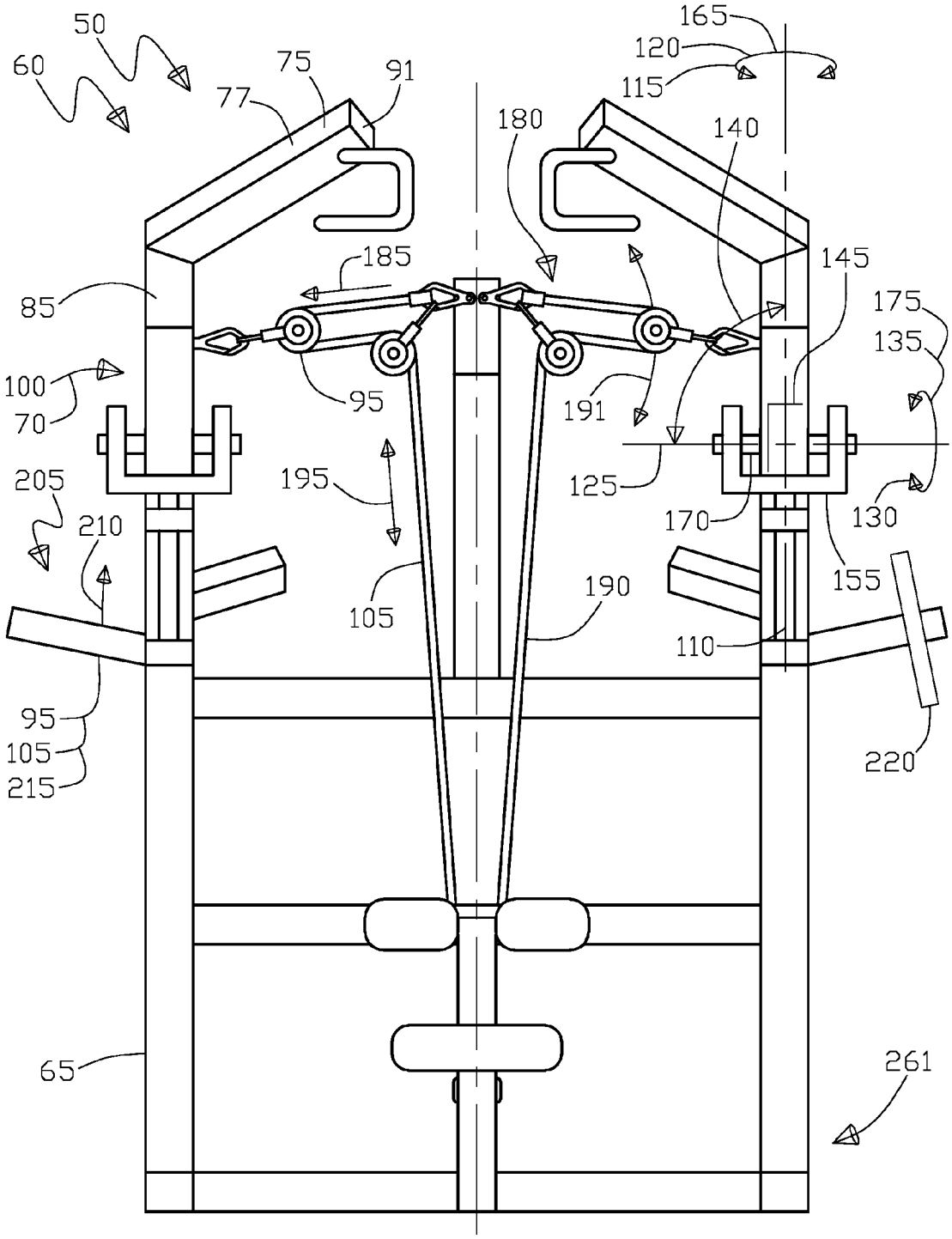
FIG. 19 shows a side elevation view from the user side of the exercise apparatus, being specifically the back embodiment in the at rest positional state.
Figure 20:
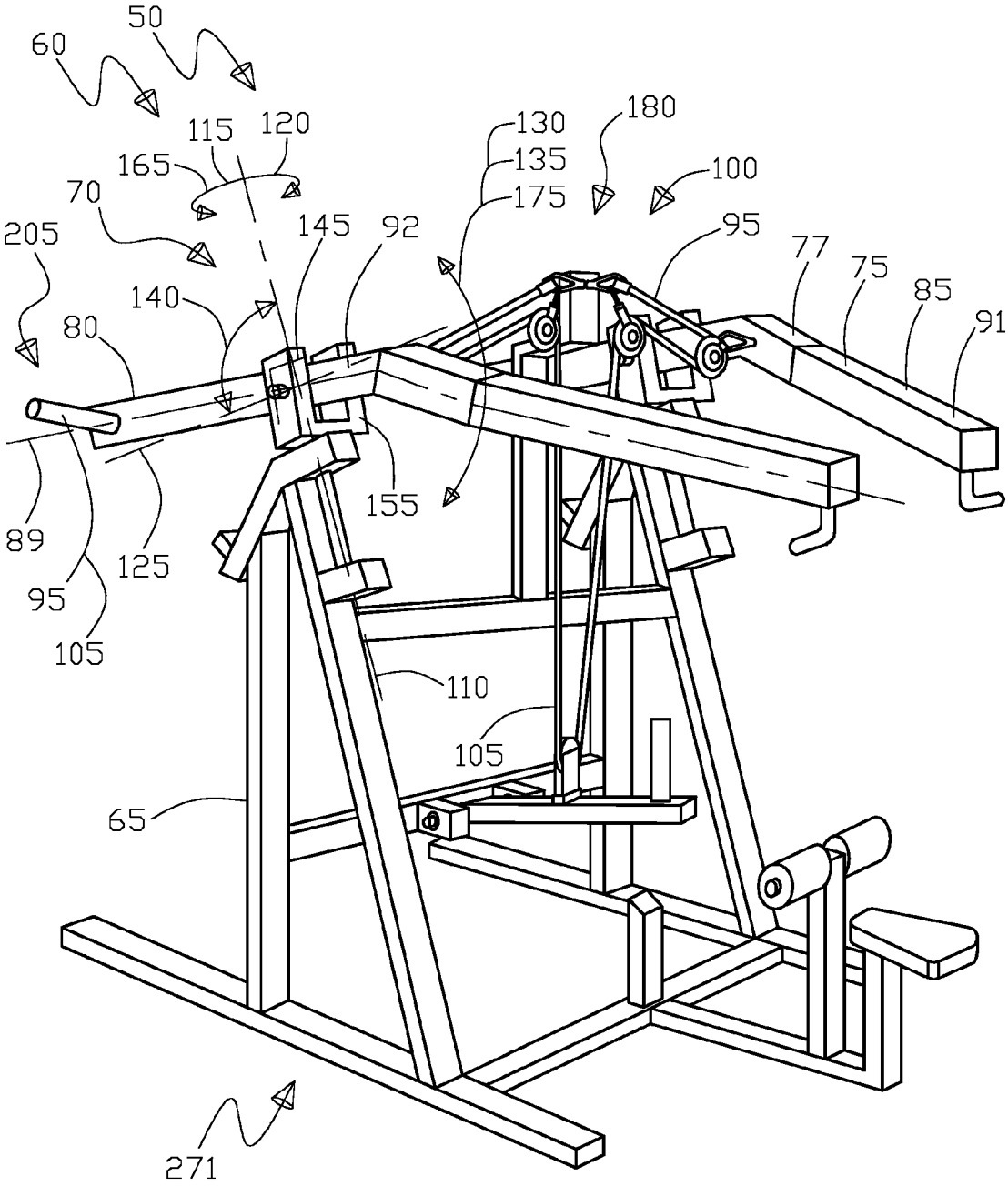
FIG. 20 shows a perspective view from the user side of the exercise apparatus, being specifically the back embodiment in the extended positional state with movement in both the first rotational arc being about the first axis and movement in the second rotational arc being about the second axis from the at rest positional state.
Figure 21:
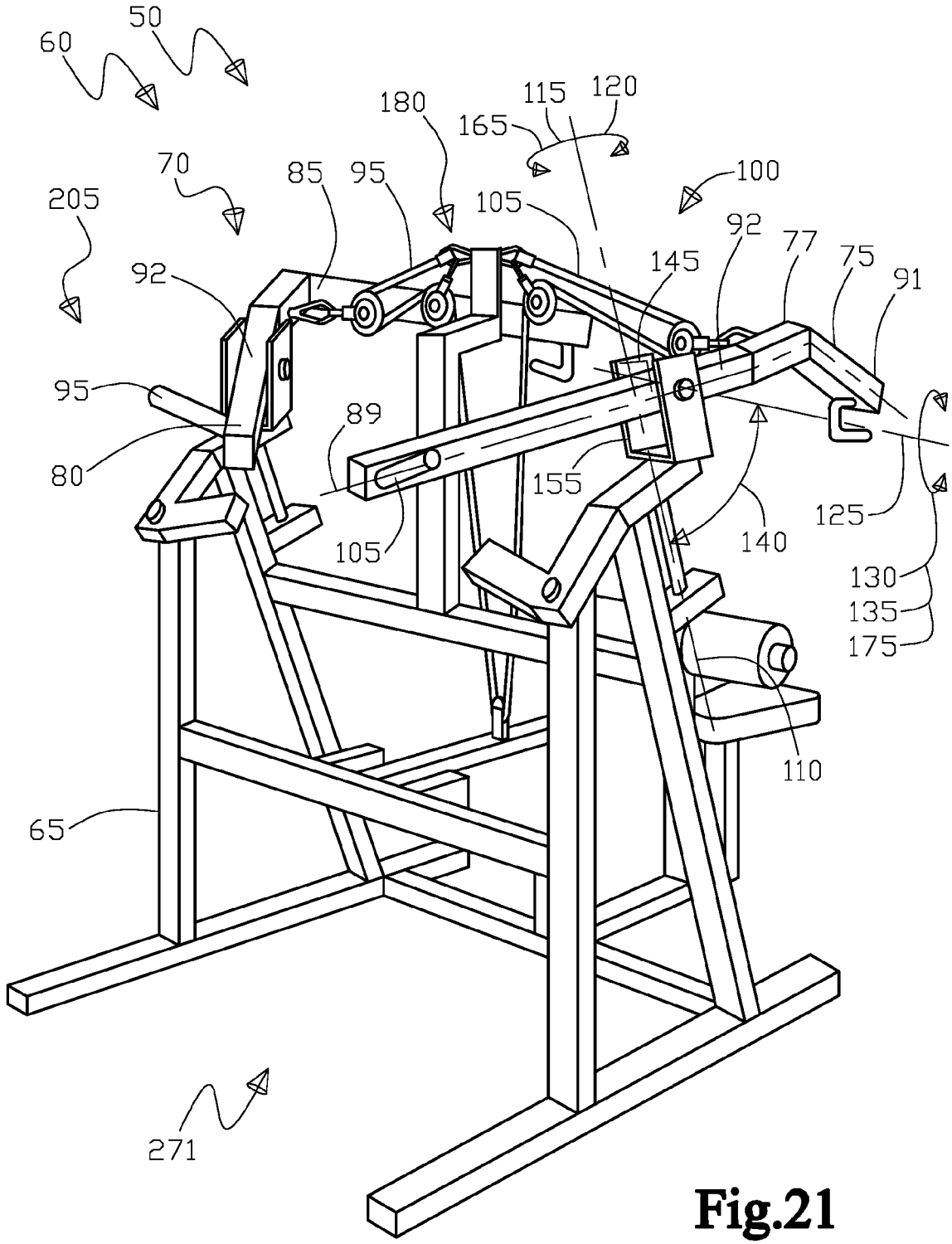
FIG. 21 shows a perspective view from opposite of the user side of the exercise apparatus, being specifically the back embodiment in the extended positional state with movement in both the first rotational arc being about the first axis and movement in the second rotational arc being about the second axis from the at rest positional state.

Continuing, FIG. 15 shows a perspective view of the exercise apparatus 50, being specifically the back embodiment 60 in the at rest 261 positional state from opposite of the user's 225, 227 side and FIG. 16 shows a perspective view of the exercise apparatus 50, being specifically the back embodiment 60 in the at rest 261 positional state from the user's 225, 227 side. Further, FIG. 17 shows a perspective view from opposite of the user 225, 227 side of the exercise apparatus 50, being specifically the back embodiment 60 in the extended 271 positional state with movement in both the first rotational arc of movement resistance 120 being about the first axis 110 and movement in the second rotational arc of movement resistance 135 being about the second axis 125 from the at rest 261 positional state. Yet further, FIG. 18 shows a perspective view from the user 225, 227 side of the exercise apparatus 50, being specifically the back embodiment 60 in the extended 271 positional state with movement in both the first rotational arc of movement resistance 120 being about the first axis 110 and movement in the second rotational arc of movement resistance 135 being about the second axis 125 from the at rest 261 positional state. Moving onward, FIG. 19 shows a side elevation view opposite of the user 225, 227 of the exercise apparatus 50, being specifically the back embodiment 60 in the at rest 261 positional state, FIG. 20 shows a side elevation view of the exercise apparatus 50, being specifically the back embodiment 60 in the at rest 261 positional state, and FIG. 21 shows a side elevation view from the user 225, 227 side of the exercise apparatus 50, being specifically the back embodiment 60 in the at rest 261 positional state.

Figure 22:
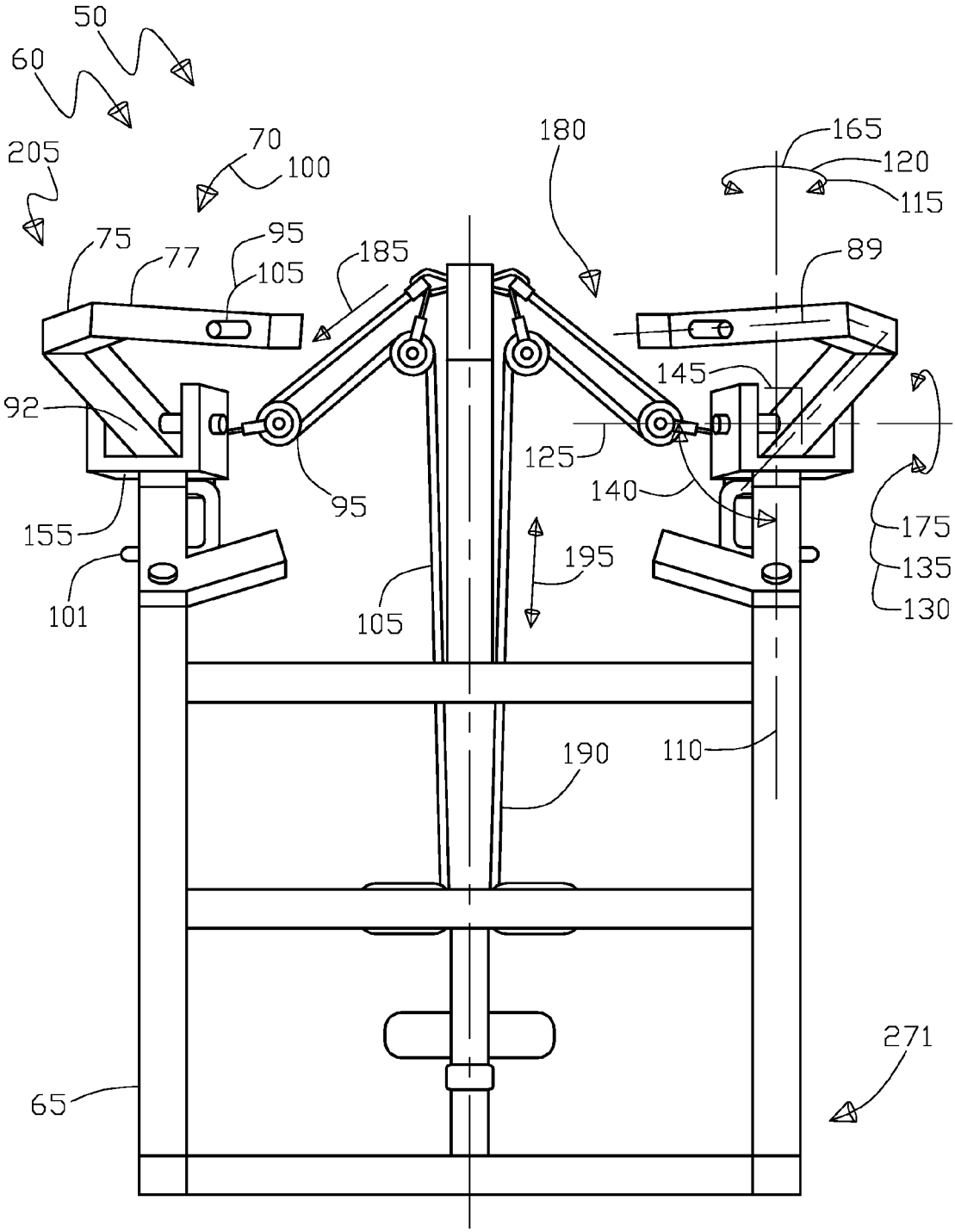
FIG. 22 shows a side elevation view from opposite of the user side of the exercise apparatus, being specifically the back embodiment in the extended positional state with movement in both the first rotational arc being about the first axis and movement in the second rotational arc being about the second axis from the at rest positional state.
Figure 23:
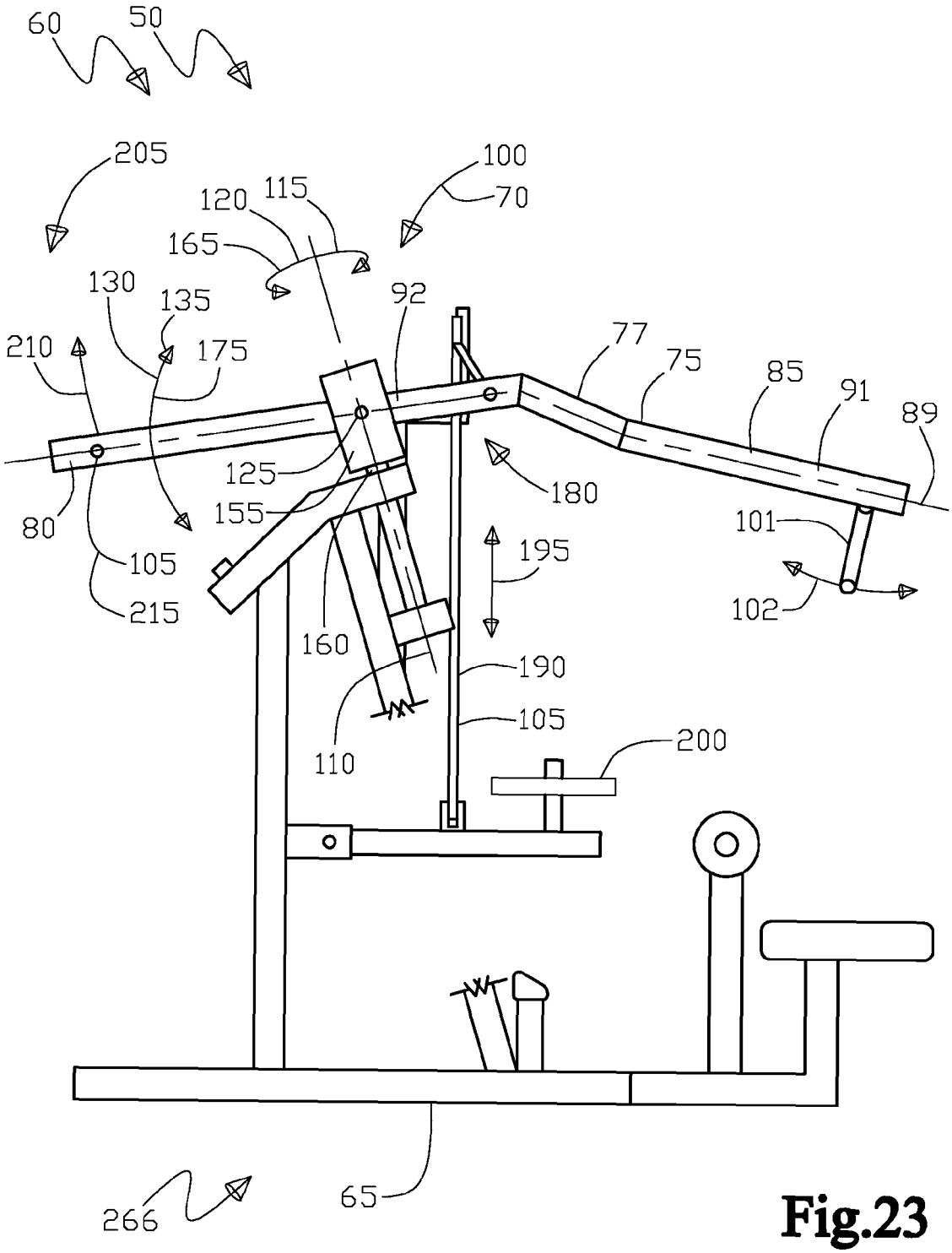
FIG. 23 shows a side elevation view of the exercise apparatus, being specifically the back embodiment in the extended positional state with movement in the second rotational arc being about the second axis from the at rest positional state.
Figure 24:
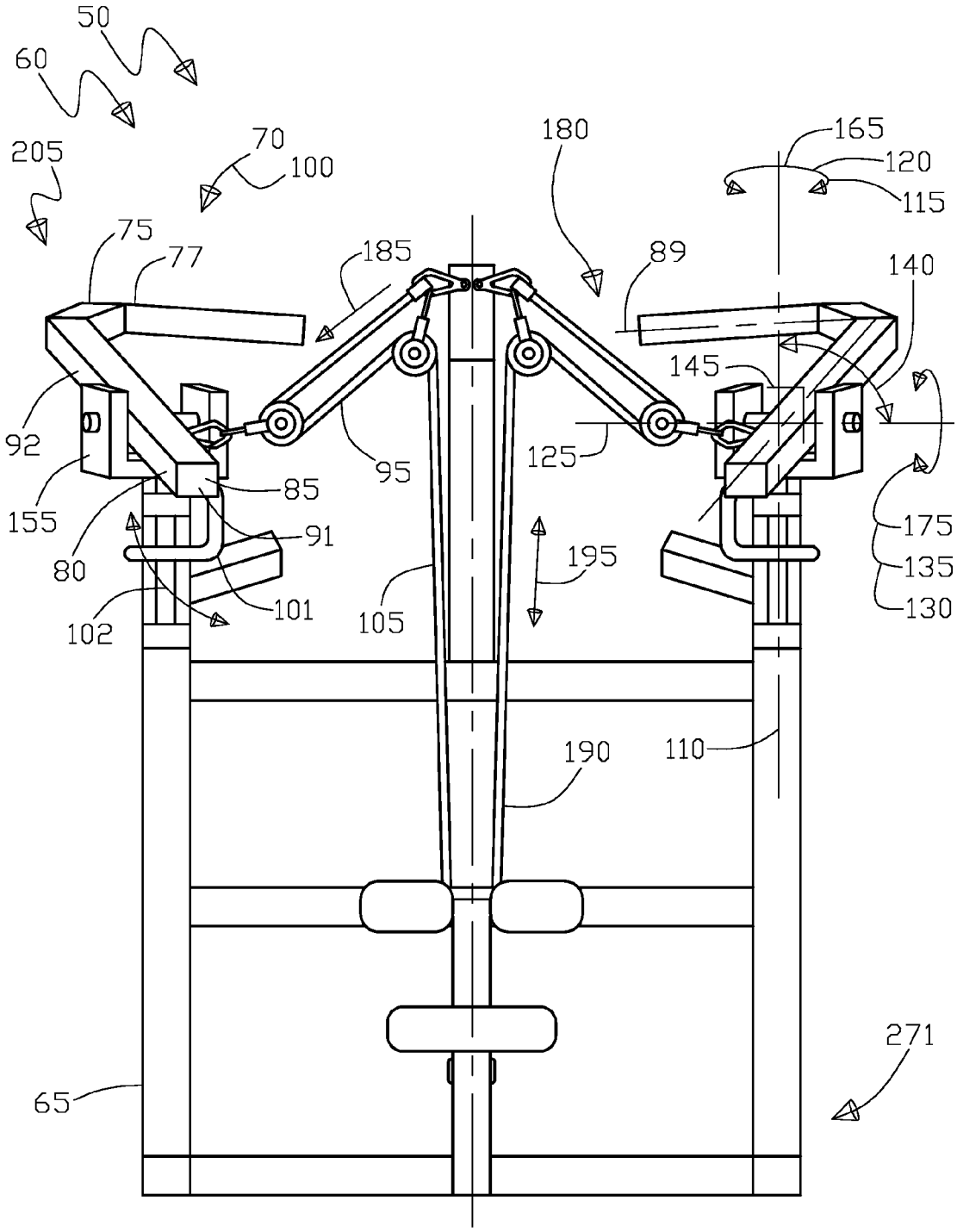
FIG. 24 shows a side elevation view from the user side of the exercise apparatus, being specifically the back embodiment in the rest positional state.
Figure 25:
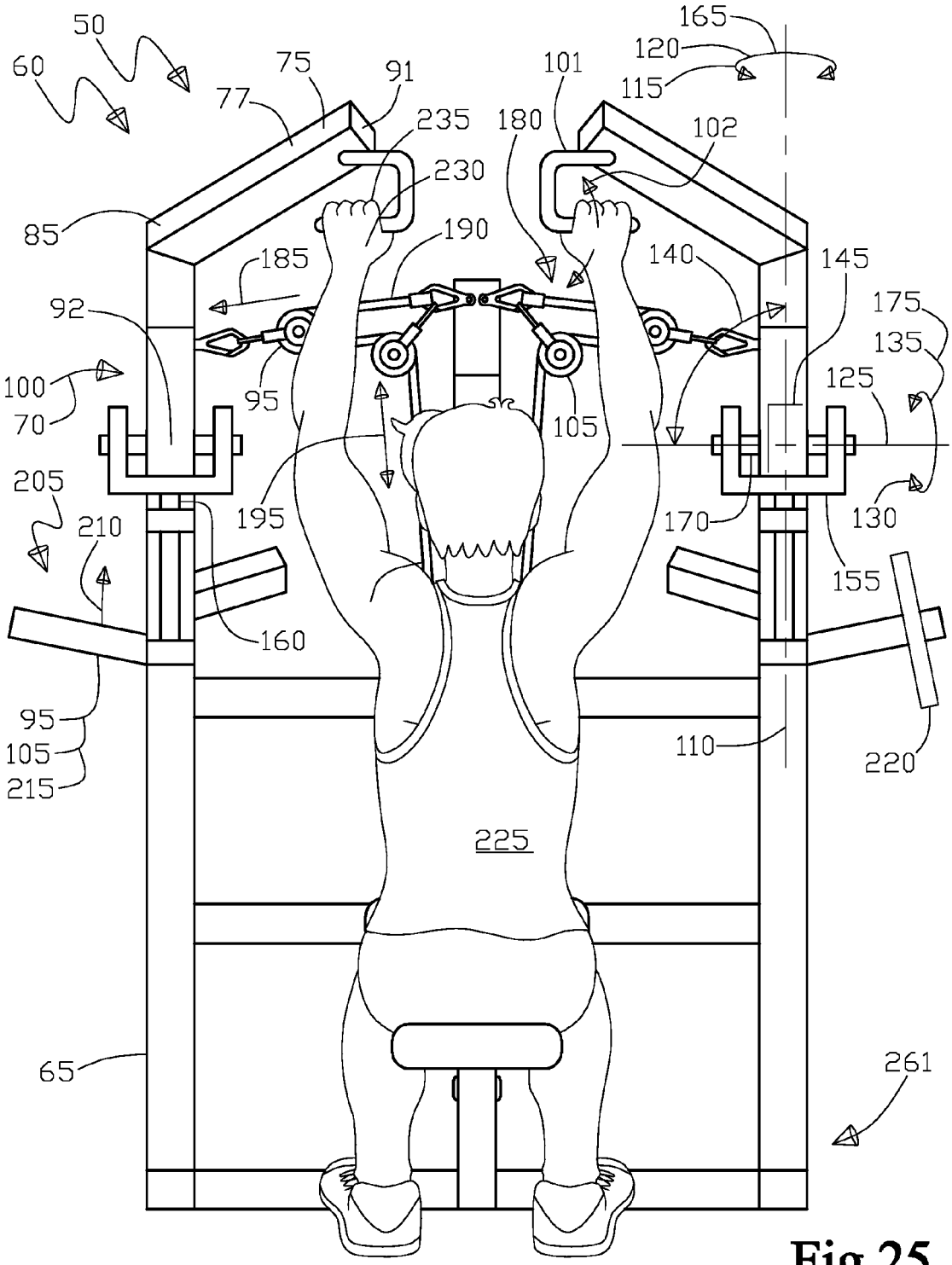
FIG. 25 shows a side elevation view from the user side in use by a user of the exercise apparatus, being specifically the back embodiment in the rest positional state.
Figure 26:
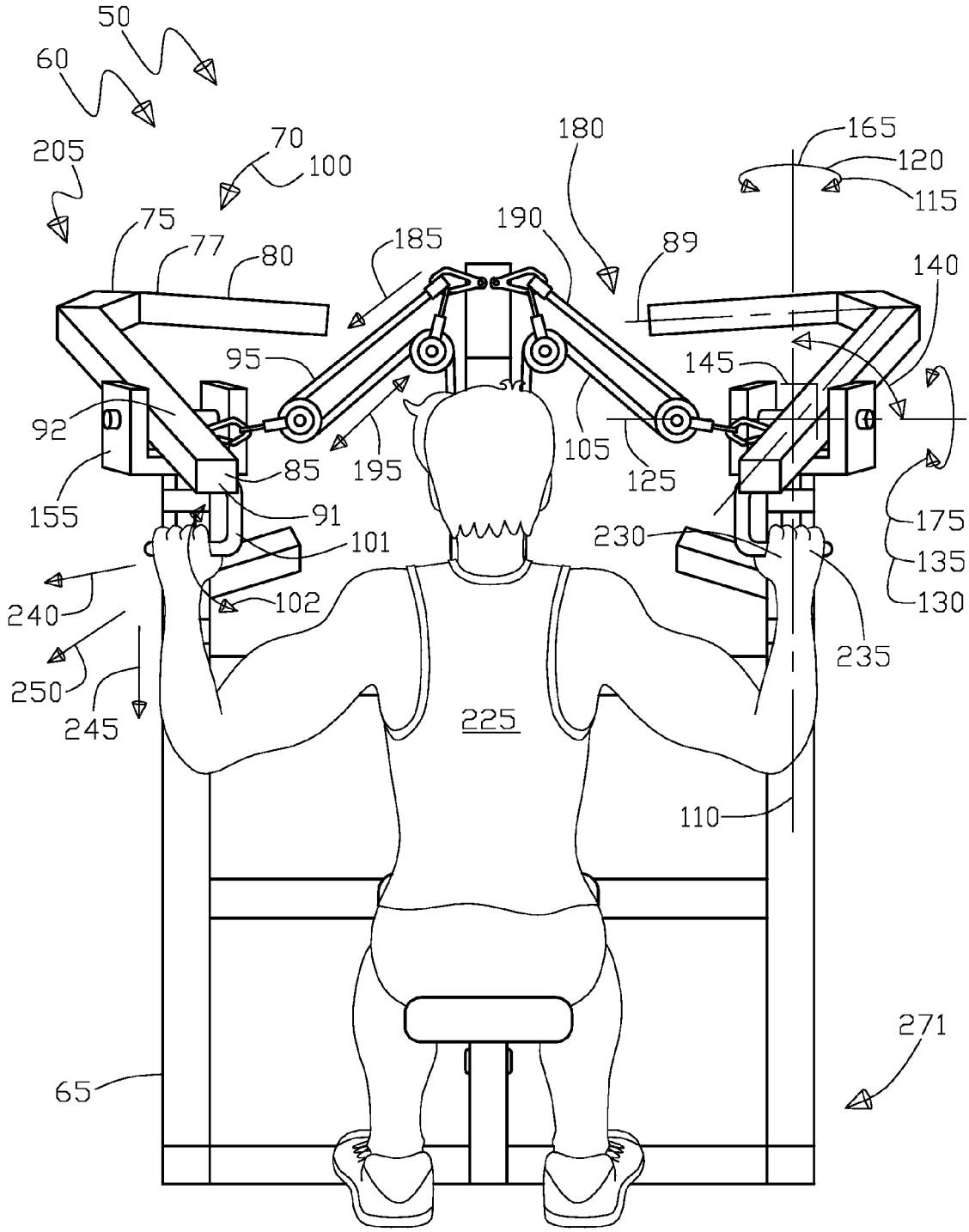
FIG. 26 shows a side elevation view from the user side in use by a user of the exercise apparatus, being specifically the back embodiment in the extended positional state with movement in both the first rotational arc being about the first axis and movement in the second rotational arc being about the second axis from the at rest positional state.

Next, shown is FIG. 22 that shows a side elevation view from opposite of the user 225, 227 side of the exercise apparatus 50, being specifically the back embodiment 60 in the extended 271 positional state with movement in both the first rotational arc of movement resistance 120 being about the first axis 110 and movement in the second rotational arc of movement resistance 135 being about the second axis 125 from the at rest 261 positional state. Continuing forward, FIG. 23 shows a side elevation view of the exercise apparatus 50, being specifically the back embodiment 60 in the extended 266 positional state with movement in the second rotational arc of movement resistance 135 being about the second axis 125 from the at rest 261 positional state. Next, FIG. 24 shows a side elevation view from the user 225, 227 side of the exercise apparatus 50, being specifically the back embodiment 60 in the rest 261 positional state and FIG. 25 shows a side elevation view from the user 225, 227 side in use by a user 227 of the exercise apparatus 50, being specifically the back embodiment 60 in the rest 261 positional state. Next, FIG. 26 shows a side elevation view from the user 225, 227 side in use by a user of the exercise apparatus 50, being specifically the back embodiment 60 in the extended 271 positional state with movement in both the first rotational arc of movement resistance 120 being about the first axis 110 and movement in the second rotational arc of movement resistance 135 being about the second axis 125 from the at rest 261 positional state.

Figure 27:
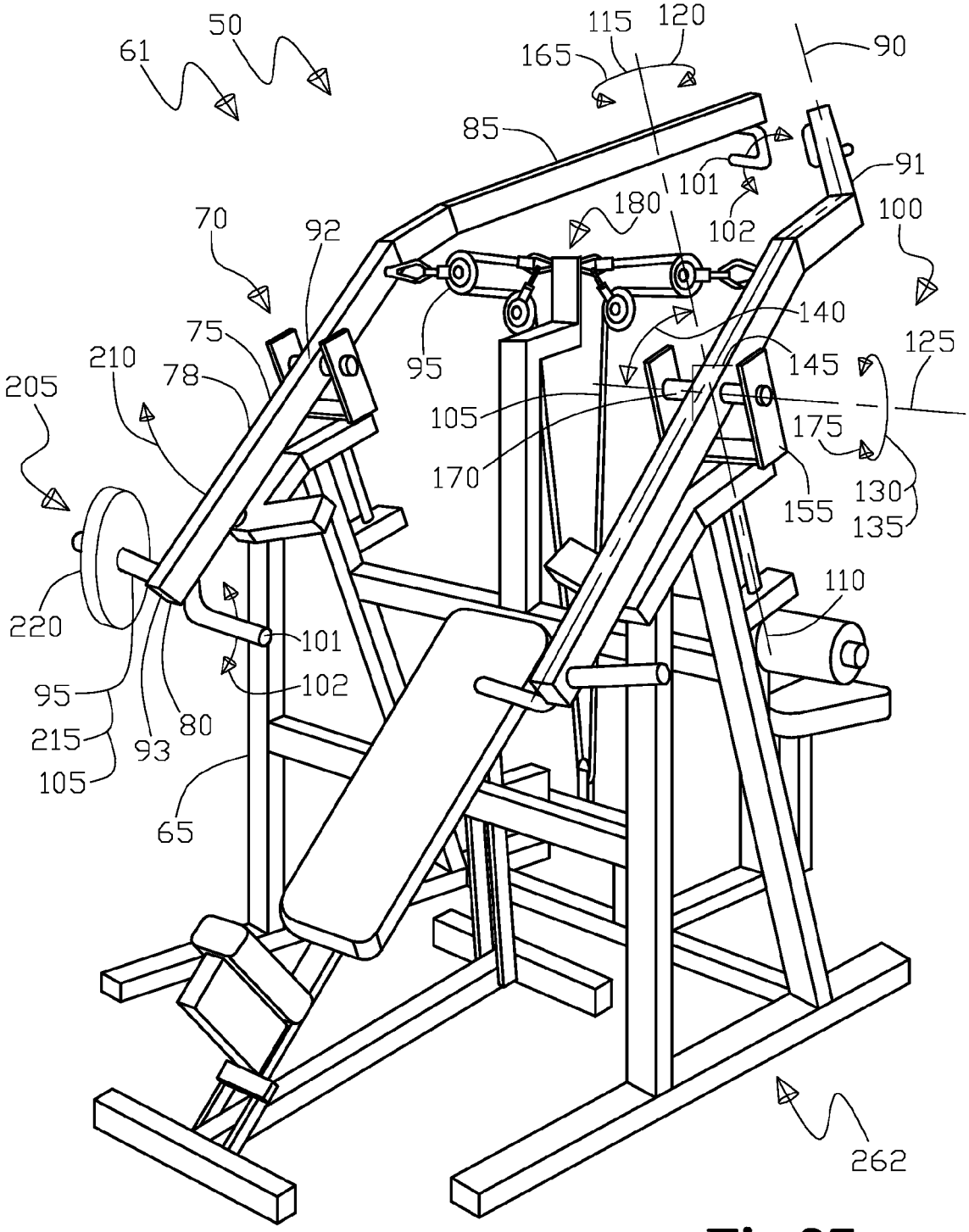
FIG. 27 shows a perspective view of the exercise apparatus, being specifically the chest and back combination embodiment in the at rest positional state from the chest user's side.
Figure 28:
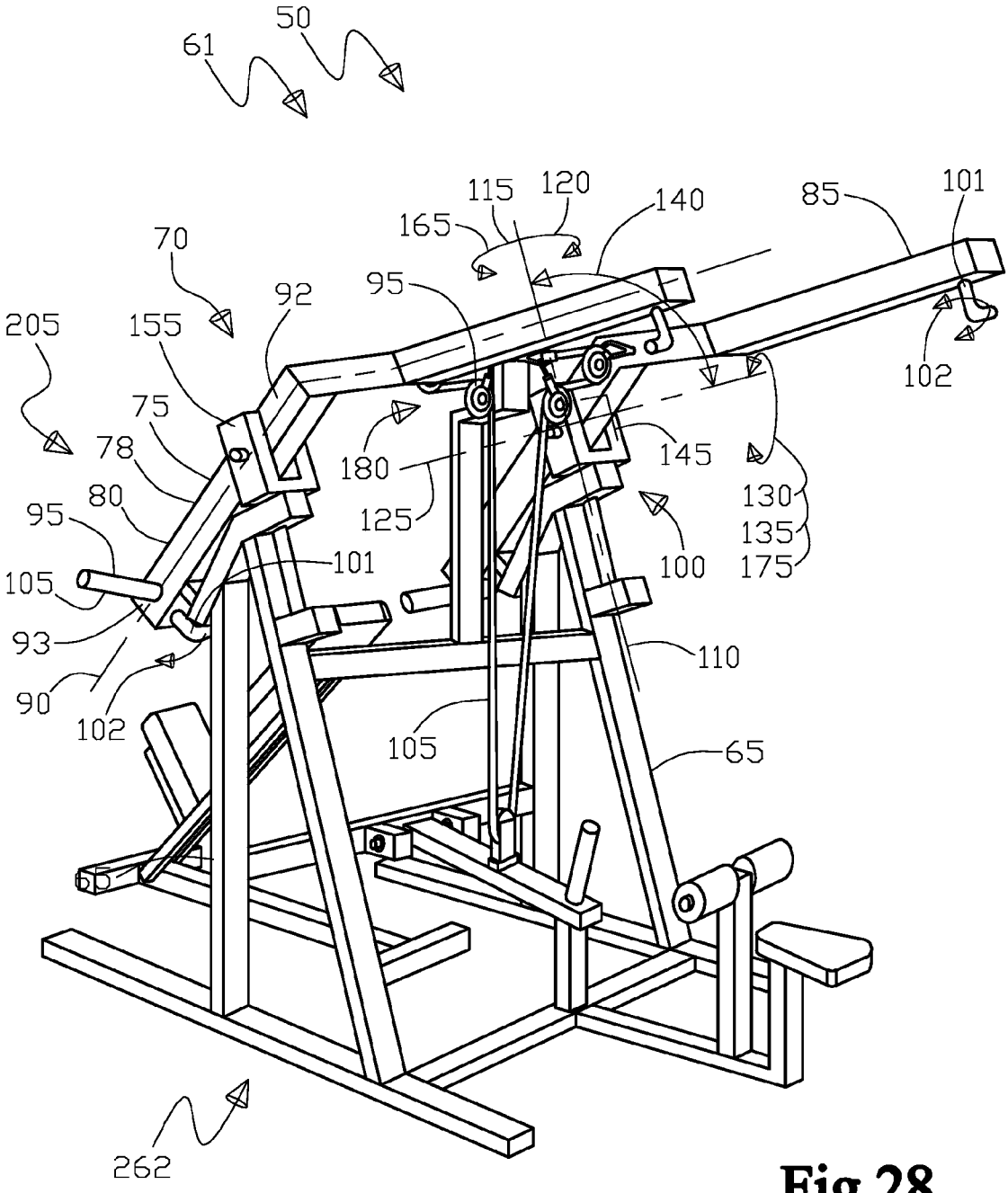
FIG. 28 shows a perspective view of the exercise apparatus, being specifically the chest and back combination embodiment in the at rest positional state from the back user's side.
Figure 29:
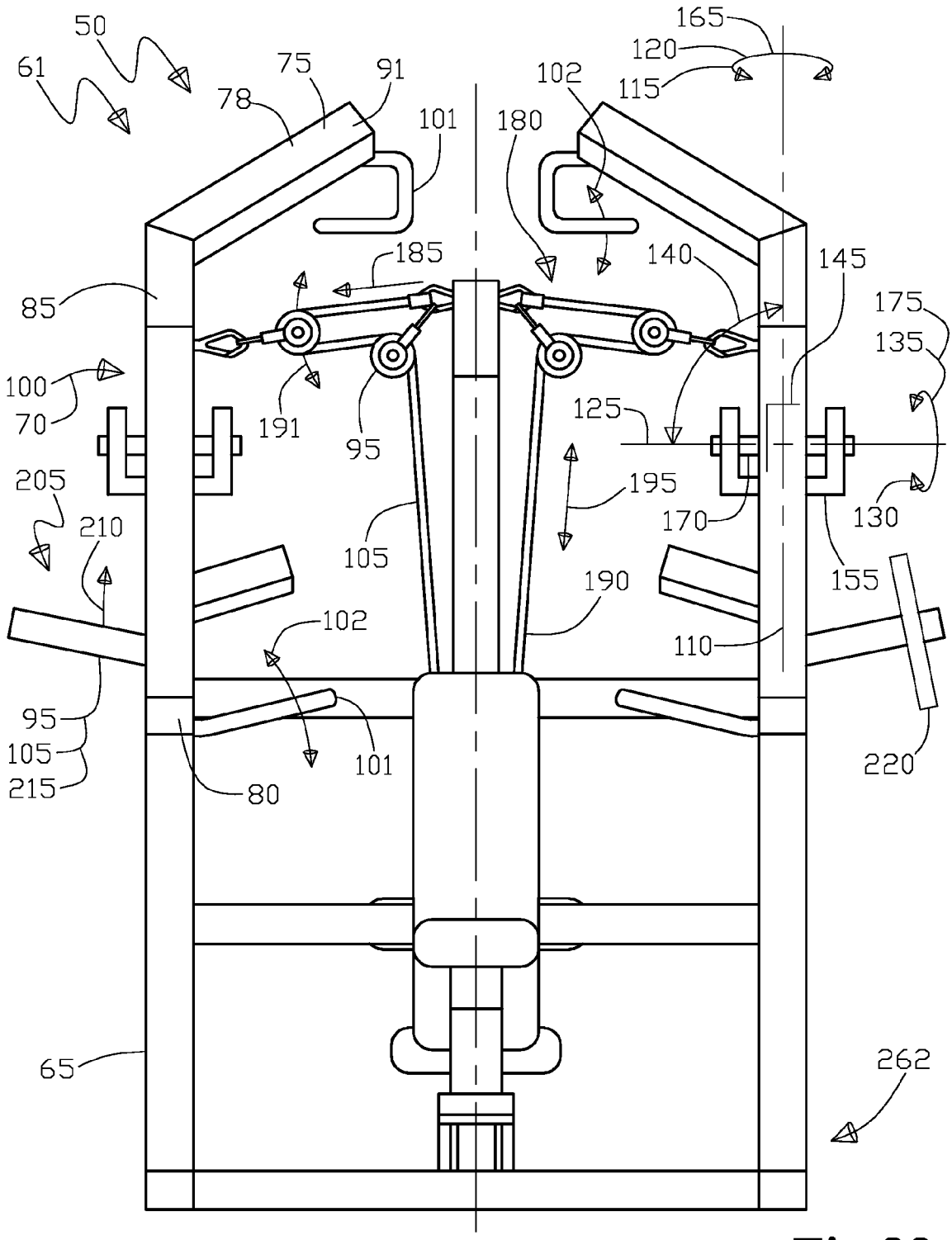
FIG. 29 shows a side elevation view of the exercise apparatus, being specifically the chest and back combination embodiment in the at rest positional state from the chest user's side.
Figure 30:
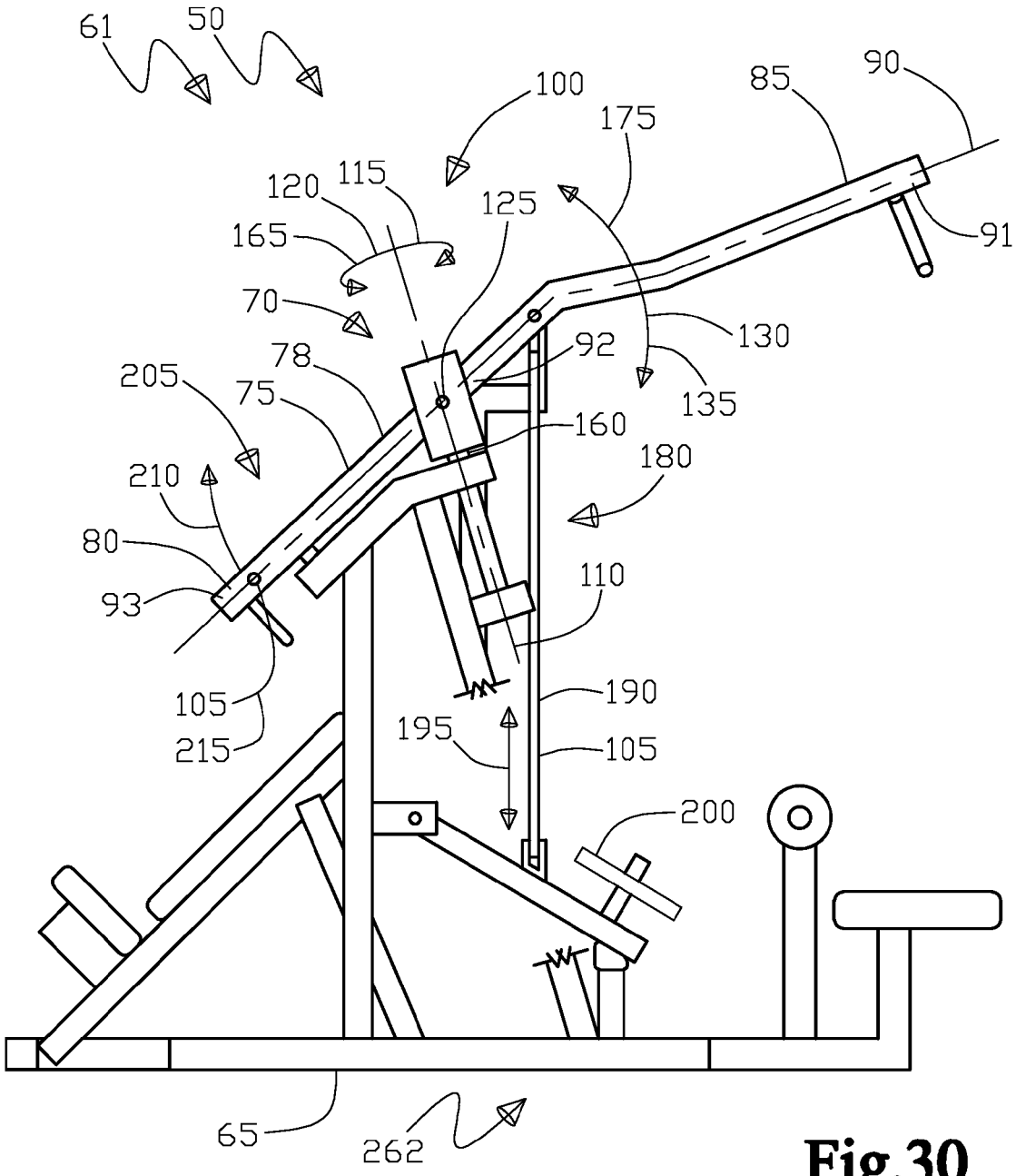
FIG. 30 shows a side elevation view of the exercise apparatus, being specifically the chest and back combination embodiment in the at rest positional state.
Figure 31:
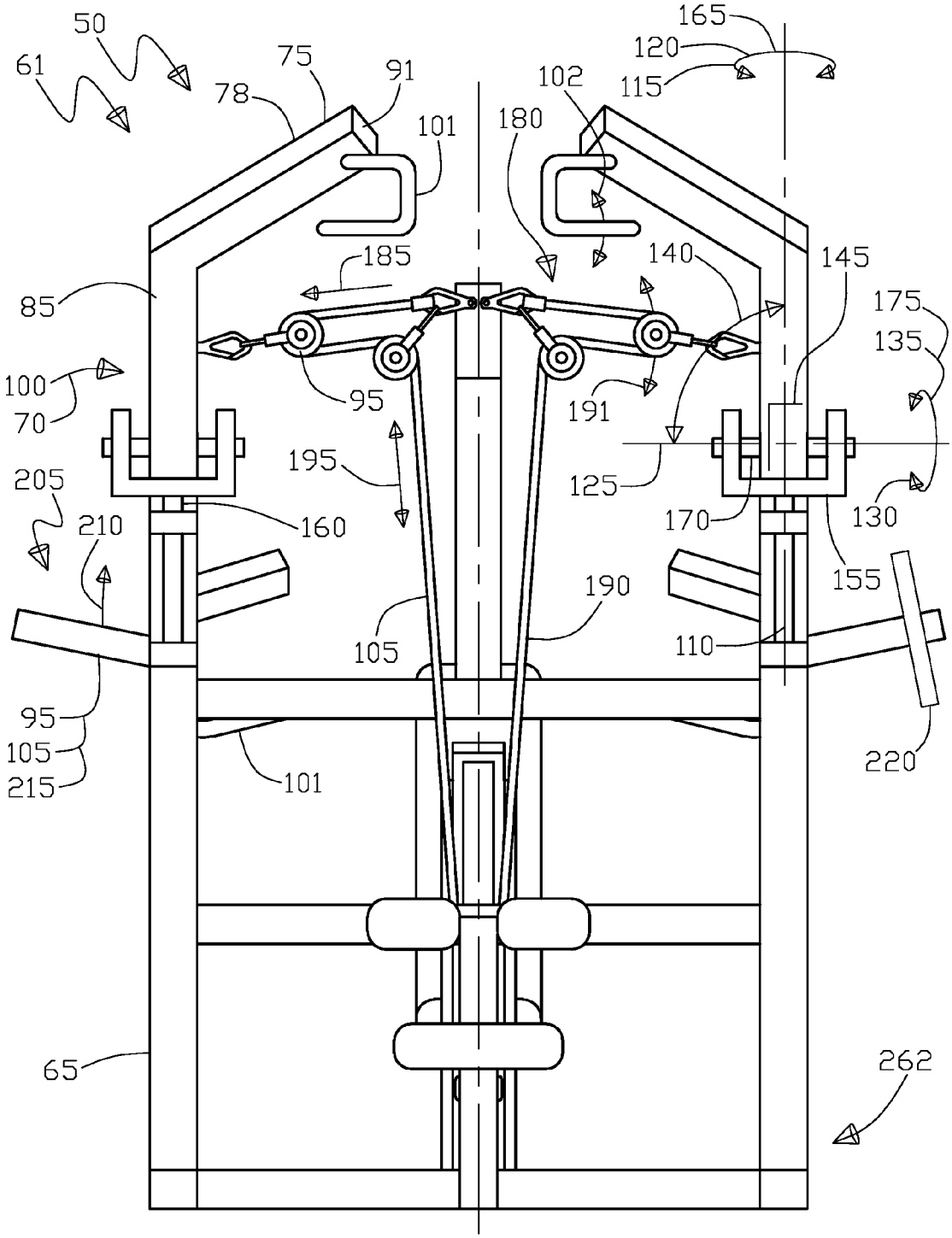
FIG. 31 shows a side elevation view of the exercise apparatus, being specifically the chest and back combination embodiment in the at rest positional state from the back user's side.
Figure 32:
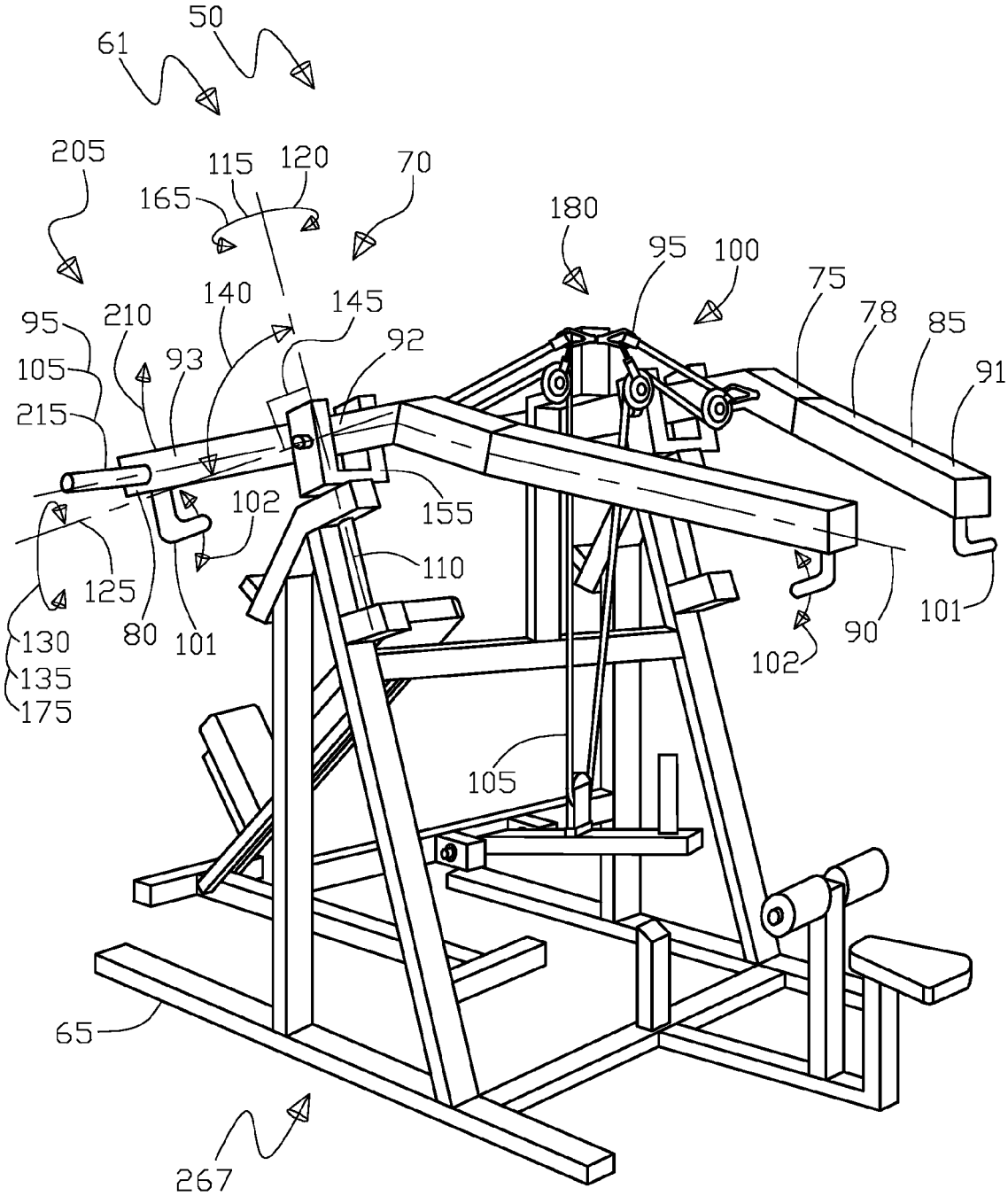
FIG. 32 shows a perspective view of the exercise apparatus, being specifically the chest and back combination embodiment in the extended positional state from the back user's side, with movement in both the first rotational arc being about the first axis and movement in the second rotational arc being about the second axis from the at rest positional state.
Figure 33:
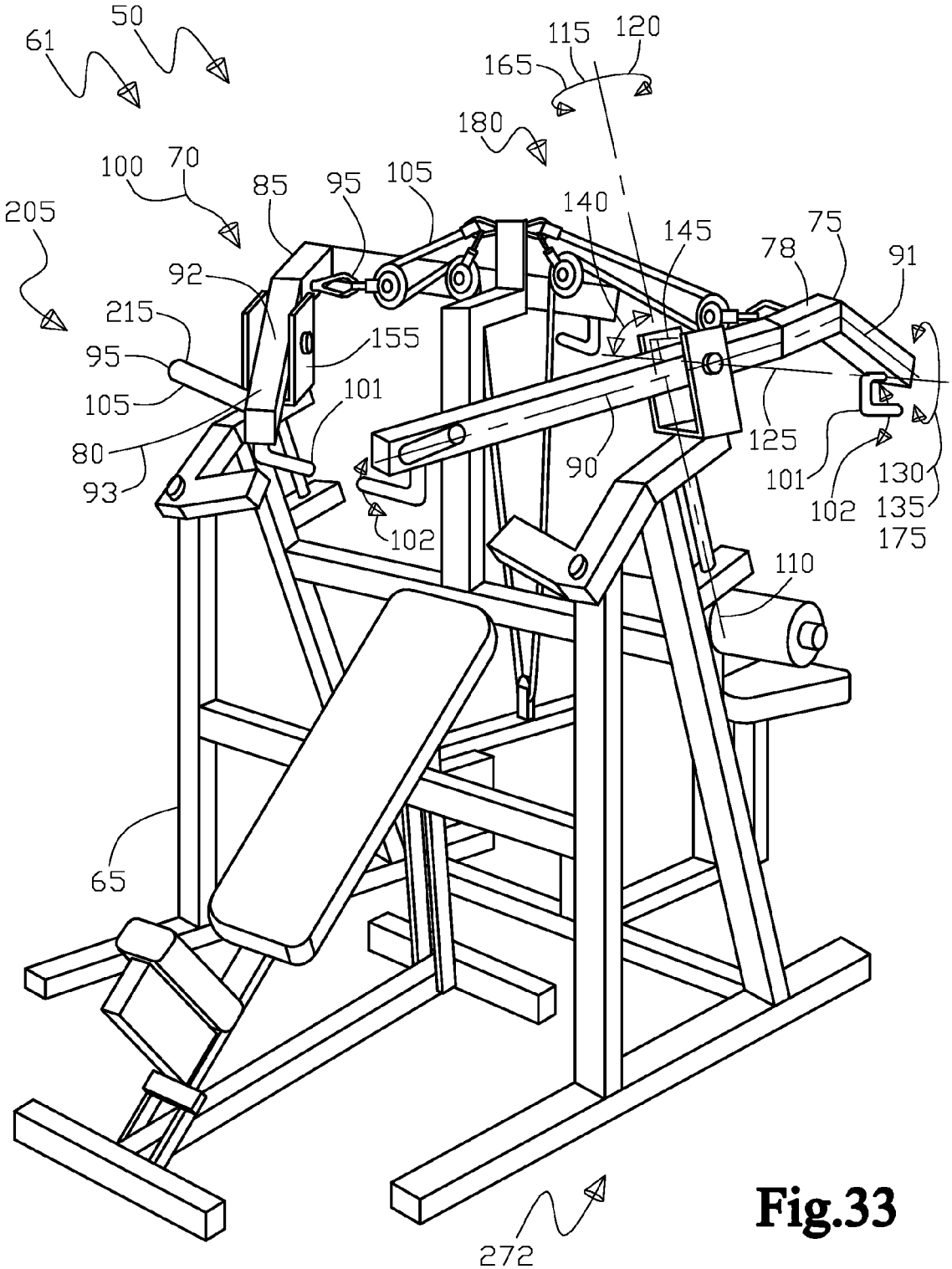
FIG. 33 shows a perspective view of the exercise apparatus, being specifically the chest and back combination embodiment in the extended positional state from the chest user's side, with movement in both the first rotational arc being about the first axis and movement in the second rotational arc being about the second axis from the at rest positional state.

Further, FIG. 27 shows a perspective view of the exercise apparatus 50, being specifically the chest and back combination embodiment 61 in the at rest 262 positional state from the chest user's 226 side and FIG. 28 shows a perspective view of the exercise apparatus 50, being specifically the chest and back combination embodiment 61 in the at rest 262 positional state from the back user's 227 side. Next, looking forward FIG. 29 shows a perspective view of the exercise apparatus 50, being specifically the chest and back combination embodiment 61 in the extended 272 positional state from the chest user's 226 side, with movement in both the first rotational arc of movement resistance 120 being about the first axis 110 and movement in the second rotational arc of movement resistance 135 being about the second axis 125 from the at rest 262 positional state. Moving onward, FIG. 30 shows a perspective view of the exercise apparatus 50, being specifically the chest and back combination embodiment 61 in the extended 272 positional state from the back user's 227 side, with movement in both the first rotational arc of movement resistance 120 being about the first axis 110 and movement in the second rotational arc of movement resistance 135 being about the second axis 125 from the at rest 262 positional state. Further, FIG. 31 shows a side elevation view of the exercise apparatus 50, being specifically the chest and back combination embodiment 61 in the at rest 262 positional state from the chest user's 226 side, FIG. 32 shows a side elevation view of the exercise apparatus 50, being specifically the chest and back combination embodiment 61 in the extended 267 positional state, and FIG. 33 shows a side elevation view of the exercise apparatus 50, being specifically the chest and back combination embodiment 61 in the at rest 262 positional state from the back user's 227 side.

Figure 34:
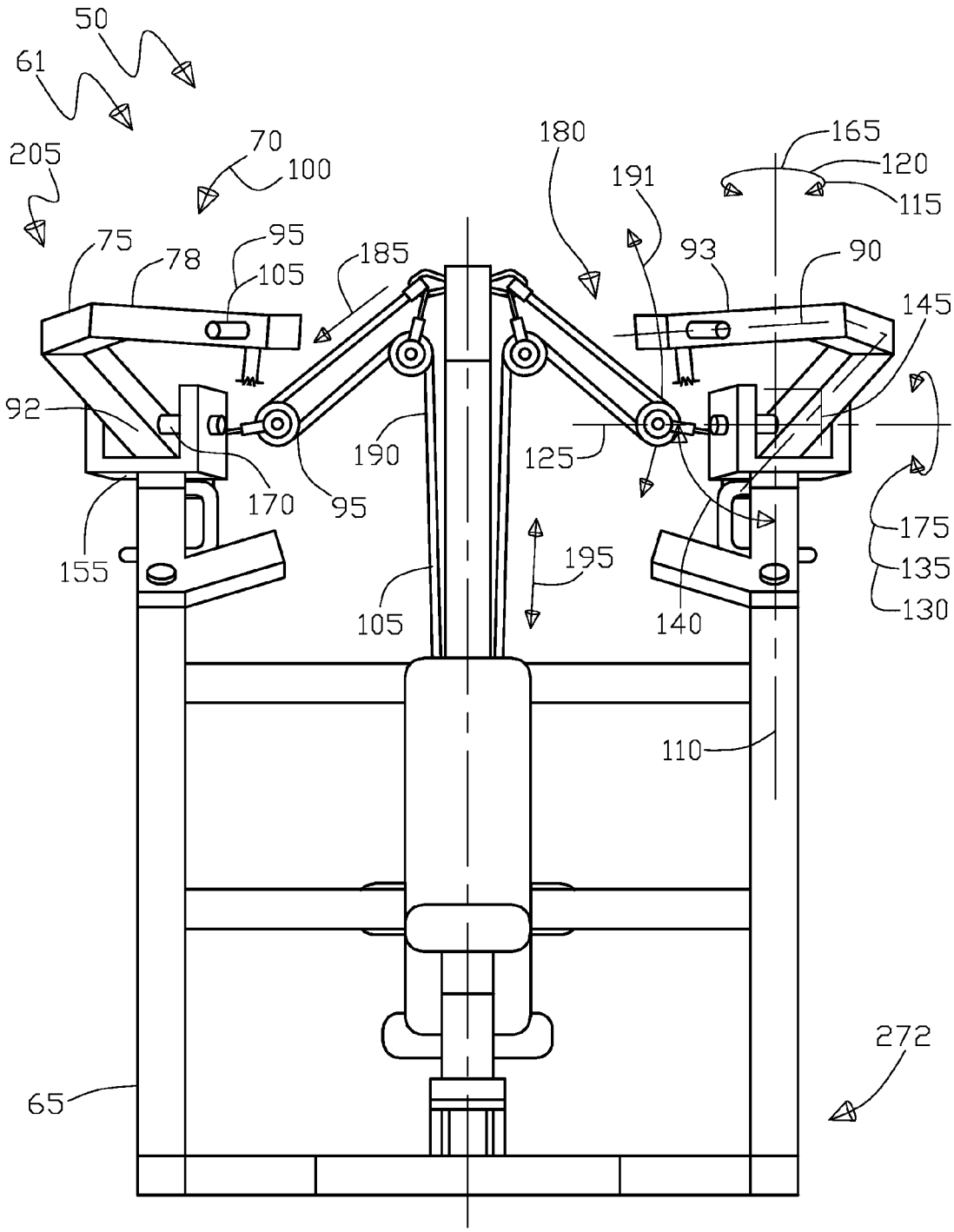
FIG. 34 shows a side elevation view of the exercise apparatus, being specifically the chest and back combination embodiment in the extended positional state from the chest user's side, with movement in both the first rotational arc being about the first axis and movement in the second rotational arc being about the second axis from the at rest positional state.
Figure 35:
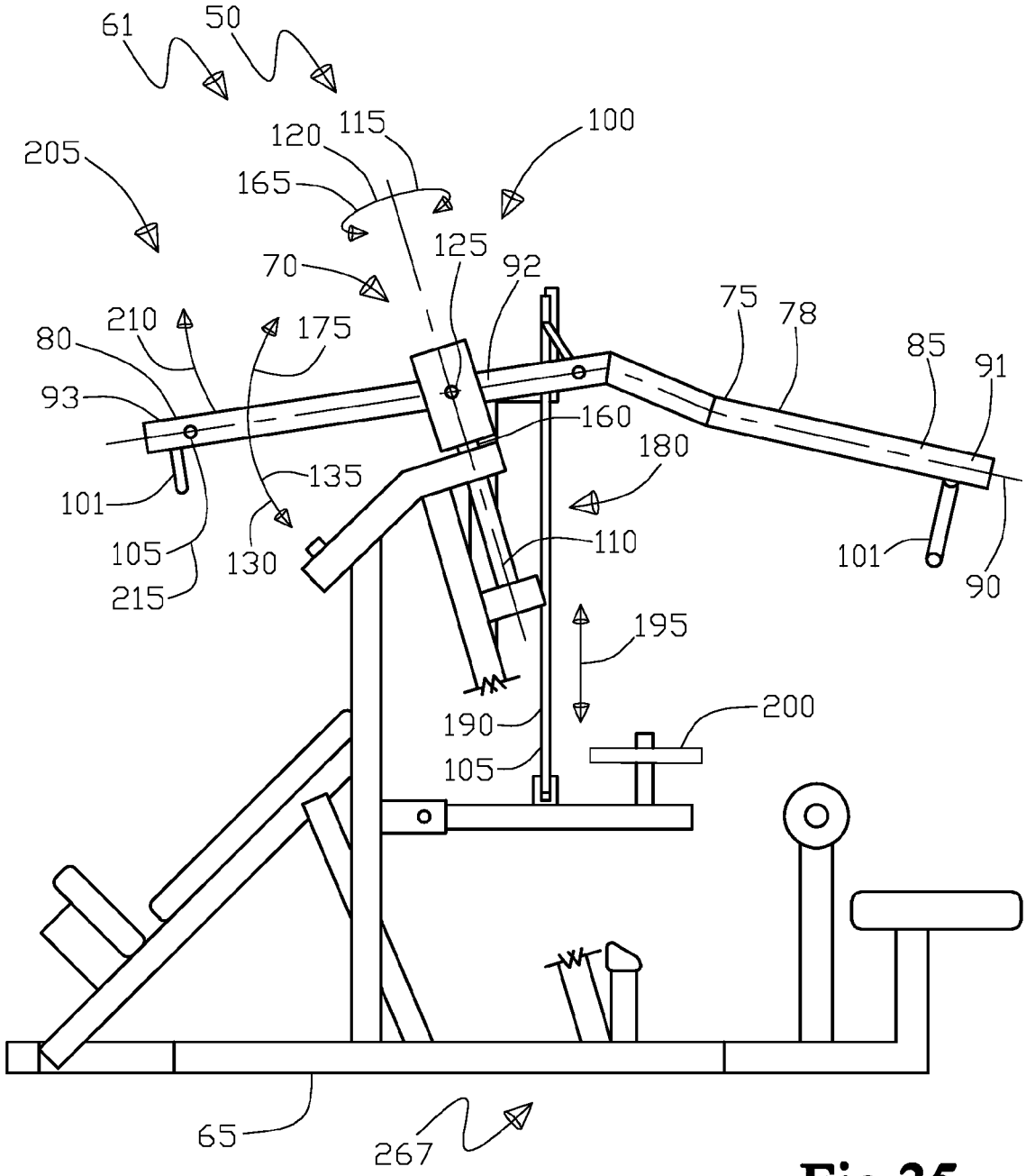
FIG. 35 shows a side elevation view of the exercise apparatus, being specifically the chest and back combination embodiment in the extended positional state with movement in both the first rotational arc being about the first axis and movement in the second rotational arc being about the second axis from the at rest positional state.
Figure 36:
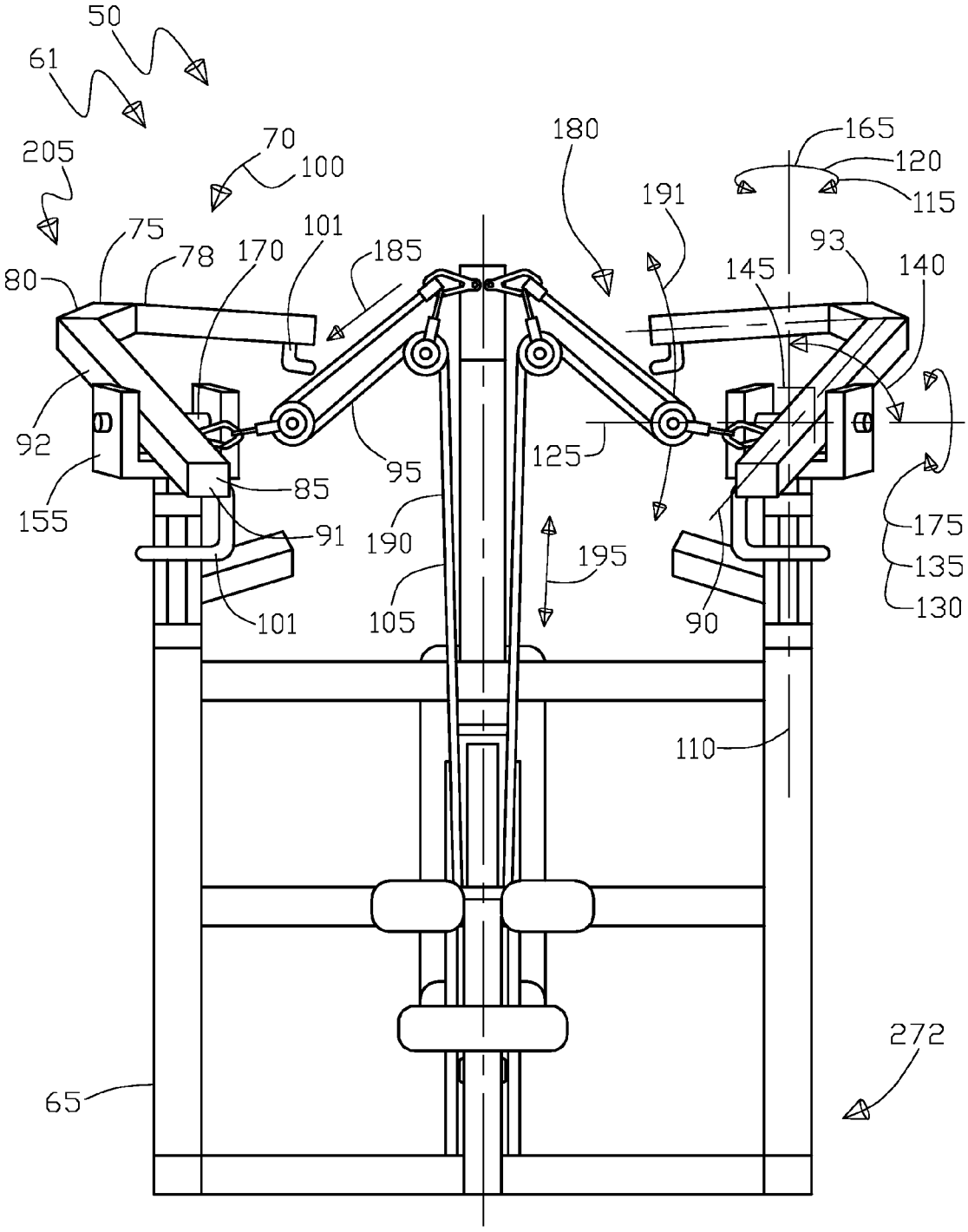
FIG. 36 shows a side elevation view of the exercise apparatus, being specifically the chest and back combination embodiment in the extended positional state from the back user's side, with movement in both the first rotational arc being about the first axis and movement in the second rotational arc being about the second axis from the at rest positional state.

Going forward, FIG. 34 shows a side elevation view of the exercise apparatus 50, being specifically the chest and back combination embodiment 61 in the extended 272 positional state from the chest user's 226 side, with movement in both the first rotational arc of movement resistance 120 being about the first axis 110 and movement in the second rotational arc of movement resistance 135 being about the second axis 125 from the at rest 262 positional state, Subsequently, FIG. 35 shows a side elevation view of the exercise apparatus 50, being specifically the chest and back combination embodiment 61 in the extended 267 positional state with movement in the second rotational arc of movement resistance 135 being about the second axis 125 from the at rest 262 positional state. Furthermore, FIG. 36 shows a side elevation view of the exercise apparatus 50, being specifically the chest and back combination embodiment 61 in the extended 272 positional state from the back user's 227 side, with movement in both the first rotational arc of movement resistance 120 being about the first axis 110 and movement in the second rotational arc of movement resistance 135 being about the second axis 125 from the at rest 262 positional state.

Broadly, in referring to FIGS. 1 to 36 the present invention is a multi-axes exercise apparatus 50 to further enhance the movement of the weight resistance load in more than one direction. Further embodiments of the exercise apparatus includes the chest version 55 as shown in FIGS. 1 to 11, the back version 60 as shown in FIGS. 15 to 24, and the combined chest and back versions 61 as shown in FIGS. 22 to 36. The present invention of an exercise apparatus 50 and more particularly the chest embodiment 55, follows with the initial description of the chest version 55 as best shown in FIGS. 1 to 11, that includes a base structure 65, a multiple axes pivotal mechanism 70 disposed adjacent to the base structure 65, and an arm 75 or more specifically arm 76. The arm 76 further includes a distal end portion 80 and a proximal end portion 85 with a longitudinal axis 89 spanning therebetween. The distal 80 and proximal 85 end portions are adapted to provide at least two independent axes, preferably being the axes of the first axis 110 and the second axis 125, of the resistive forces 95 to user 225 muscle exertion, with the proximal end portion 85 being adjacent to the mechanism 70 such that operationally at least two independent axes 100 of simultaneous movement occur in the arm 76 relative to the structure 65. Further, the arm 76 has a handle 101 disposed on the distal end portion 80 that is used to removably engage a portion of the user's 225 anatomy 230, wherein the handle 101 is pivotally movable 102 to better accommodate the combined movement 250 as stemming from movements 240 and 245 combined as best shown in FIGS. 12 through 14.

Also included in the exercise apparatus 55 is a means 105 for creating independently selectable variable resistance forces to the movement of the arm 76 relative to the structure 65, such that each axis 100 of movement has an independent selectable variable resistance force to the arm 76 movement. The structure 65 as best shown in all of the FIGS. 1 through 36 for all of the embodiments of the exercise apparatus 50, 55, 60, and 61 supports primarily the mechanism 70, the arm 75 including arms 76, 77, or 78, and the means 105 for creating selectable variable resistance forces. Construction of the structure 65 is per current preferable conventional methods for exercise equipment frameworks being made of square, round, or rectangular steel stock with a wall thickness of about 11 gauge or roughly one-eighth inch (⅛) to one-quarter inch (¼) in thickness being of welded attachment as between the steel stock sections, note that this type of construction would also apply to the arms 75, 76, 77, and 78, as well. However other construction materials and attachments would be acceptable as long as the strength requirements of the loads imposed upon the structure 65 and arms 75, 76, 77, and 78, by the maximum first and second selected weights 200 and 220, respectively when the exercise apparatus 50, 55, 60, and 61 is in use.

Further to the detail of the mechanism 70, focusing in particular on FIGS. 1 to 11, the mechanism 70 is sized and configured such that the arm 76 proximal end portion 85 pivotally rotates 115 about a first axis 110 in a first rotational arc of movement resistance 120 and the arm 76 proximal end portion 85 also pivotally rotates 130 about a second axis 125 in a second rotational arc of movement resistance 135, wherein the first 110 and second 125 axes are substantially perpendicularly 140 oriented to one another. Continuing on the mechanism 70, it is sized and configured such that the first 110 and second 125 axes are substantially in a single plane 145, to facilitate a substantially constant moment arm distance 150 along the longitudinal axis 90 between the plane 145 and the means 105 for creating selectable variable resistance forces, to operationally help facilitate the arm 76 to include a combined motion 250 by simultaneously pivotally rotating about both the first 110 and second 125 axes. Wherein, in FIG. 14 the combined motion 250 stems from the two motions of movement, being movement 240, in FIG. 14 about the first axis 110 and the movement 245, in FIG. 13 being about the second axis 125. Further, preferably the mechanism 70 is formed from a yoke element 155 that is pivotally attached 160 to the structure 65 about the first axis 110 facilitating movement 165 and the arm 75 proximal end portion 85 is pivotally attached 170 to the yoke about the second axis 125 having pivotal movement 175. Alternatively the mechanism 70 could be something other than the yoke 115 such as a universal joint, ball in socket arrangement, gimbal type bearing, or any other arrangement that would accommodate movement 240 and movement 245, as shown in FIGS. 13 and 14, and the loading from the resistance 185 from the first assemblage 180 combined with the resistance 210 from the second assemblage 205.

Further, on the mechanism 70, the yoke element 155 is preferably forms a "C" shaped channel portion that has three legs each of about eight (8) inches in length with a twelve (12) inch long extension projecting from the middle leg opposite of the interior of the "C" shaped section. Furthermore the yoke "C" shaped channel portion is preferably constructed of steel that forms a cross section of three (3) inches by one-half (½) inches, with the extension preferably constructed of one (1) inch diameter cold roll steel, all utilizing welded attachment. Note, that the yoke 155 could be constructed with other materials and methods as long as the strength requirements were maintained with the maximum weights 200 and 220 being used. The extension whose longitudinal axis is co-axial with the first axis 110 preferably rotationally resides in a pair of pillow block or flange type bearings that facilitate the pivotal rotation 115. In addition, another pair of pillow block or flange type bearings that facilitate the pivotal rotation 130 about the second axis 125 are disposed on opposing legs of the yoke 155 facing the interior of the "C" section that suspend the arm 75, 76, 77, or 78 on a shaft that is co-axial to the second axis 125. Also, other than the pillow block or flange type bearings could be used as long as again the strength requirements were maintained with the maximum weights 200 and 220 being used.

Continuing, in refocusing upon FIGS. 1 to 11, the means 105 for creating independently selectable variable resistance forces is sized and configured such that the first rotational arc of movement 120 first selected resistance 185 is created by a first assemblage 180 and the second rotational arc of movement 135 second selected resistance 210 is created by the second assemblage 205 that are each operationally independent. Wherein the first 180 and second 205 assemblages are substantially independent of one another, both in a physical structural manner and related to resistance 185 and second selected resistance 210 that are independently selectable, such that operationally the first assemblage 180 could have a first selected resistance 185 and the second assemblage 205 could be selected to have no second selected resistance 210 or the second assemblage 205 could have a second selected resistance 210 and the first assemblage 180 could be selected to have no resistance 185 or the first assemblage 180 could have a first selected resistance 185 and the second assemblage 205 could have a selected different second selected resistance 210. Thus, the end result in that maximum flexibility is achieved for accommodating independent first selected resistance 185 and second selected resistance 210 as against movements 240 and 245 respectively as best shown in FIGS. 13 and 14. Further, in referencing the movement arc 191 as best shown in FIGS. 3, 5, 6, 8, 19, 29, 31, 34, and 36 as applied to all three embodiments of the exercise apparatus 55, 60, and 61, it can be seen how the independence the first rotational arc of movement 120 resistance 185 created by the first assemblage 180 and the second rotational arc of movement 135 second selected resistance 210 created by the second assemblage 205 is accomplished. Looking at movement arc 191 it can be seen that a fair amount of movement 191 can occur prior to movement 185, wherein movement 191 is in accordance with the second rotational arc of movement resistance 135, thus arc 191 and arc 135 move together as the arm 75 pivots about the second axis 125 without movement 120 about the first axis 110. Movement 191 results in almost no movement 185 due to the tangential arc 191 primarily moving perpendicular to movement 185, in addition to the flexible component 190 having some degree of slack in the range of about one-half inch of free play that further allows movement 191 to have almost no movement 185. The beneficial result of this separate and independent movement 191 and 185 is that there can be independent resistance as between resistance 210 of the second assemblage 205 and resistance 185 of the first assemblage 180 all manifested within a single arm 75 combined motion 250 that is a combination of movement 240 and movement 245, wherein the movement 240 and movement 245 correspond to arc movement 120 and arc movement 135 respectively. Further noting that movements 240 and 245 are separate and independent, thus a user 225 could have substantial movement 240 and little movement 245, or vice versa, or a nearly equal amount of movement 240 and 245.

Further on the assemblages, the first assemblage 180 is disposed adjacent to the proximal end portion 85 and the second assemblage 205 is disposed adjacent to the distal end portion 80, as can be seen in all of the FIGS. 1 through 26. Further, the first assemblage 180 is preferably constructed of a flexible component 190 that communicates movement from the proximal end portion 85 to a first selected weight plate 200 movably disposed upon the structure 65. The second assemblage 205 is constructed of a retainer extension 215 that removably engages a second selected weight plate 220. Returning to the first assemblage 180, the flexible component 190 is preferably a cable that is in contact with multiple pulleys as seen in all of the FIGS. 1 through 26, wherein movement 120 is translated to communication 195 eventually leading to movement of the first selected weight plate 200 that is movably disposed on the structure 65, wherein changes in the first selected weight plate 200 result in resistance changes to movement 120 that are ultimately reflected at the handles 101. The pulleys are preferably about three and one-half (3½) inches in diameter, however larger or smaller pulley diameters would be acceptable. The cable 190 is preferably about one-eighth (⅛) to one-quarter (¼) of an inch in diameter. Note that the first selected weight plate 200 that is on a pivotal arm being pivotally attached to the structure 65 and has movement 195 via the flexible component 190 can alternatively be a conventional weight stack wherein the first selected weight plates 200 are adjacent to one another in a vertical fashion moving telescopically upon vertically disposed rods with varying numbers of first selected weight plates 200 lifted simultaneously by the flexible component 190. The first selected weight plates 200 vertically adjacent arrangement has the advantage of consuming less space, allowing for a larger number of finer resistance load selections, and not having the pivotal moment arm change with movement in a given plane that alters the resistance of a given first selected weight plate 200 through its movement range.

Continuing, on the back embodiment 60 of the exercise apparatus as best shown in FIGS. 15 through 26, with the in use Figures being 25 and 26. The exercise apparatus 60 includes a base structure 65 as previously described and the multiple axes pivotal mechanism 70 also as previously described. Also included, is the arm 77 having a distal end portion 80 and a proximal end portion 85 with a longitudinal axis 89 spanning therebetween. The distal end portion 80 is adapted to provide at least two independent resistive forces 95 to muscle exertion, the distal end portion 80 is adjacent to the mechanism 70 such that operationally at least two independent axes, being preferably the first axis 110 and the second axis 125, of movement, being respectively movement 120 and movement 135 that occur in the arm 77 relative to the structure 65. Further, the arm 77 has a handle 101 disposed on the proximal end portion 85 that is used to removably engage a portion of the user's 225 anatomy 230 wherein the handle 101 is pivotally movable 102 to better accommodate the combined movement 250 as stemming from movement 240 and 245 as best shown in FIGS. 25 through 26. Further included is the means 105 for creating independently selectable variable resistance forces as previously described.

Moving onward, on the combined chest and back embodiment 61 of the exercise apparatus as best shown in FIGS. 27 through 36. The exercise apparatus 61 includes a base structure 65 as previously described and the multiple axes pivotal mechanism 70 also as previously described. Also included, is the arm 78 including a distal end portion 80 and a proximal end portion 85 with a longitudinal axis 90 spanning therebetween. The arm 78 basically being the combination of arm 76 and arm 77, wherein arm 78 includes a lat pull down end portion 91, an intermediate portion 92, and a bench push up end portion 93 with a longitudinal axis 90 spanning therebetween. The lat pull down end portion 91 and the bench push up end portion 93 are both adapted to provide independent resistive force 95 to muscle exertion, with the intermediate portion 92 being adjacent to the mechanism 70 such that operationally at least two independent axes of movement, being the first axis 110 and the second axis 125 occur in the arm 78 relative to the structure 65. The arm intermediate portion 92 pivotally rotates 115 about the first axis 110 in a first rotational arc movement 120 and the arm intermediate portion 92 also pivotally rotates 130 about the second axis 125 in a second rotational arc movement 135, wherein the first 110 and second 125 axes are substantially perpendicularly oriented to one another.

Continuing, the arm 78 has a handle 101 disposed on the proximal end portion 85 or lat pull down end portion 91 that is used to removably engage a portion of the user's 225 anatomy 230 wherein the handle 101 is pivotally movable 102 to better accommodate the combined movement 250 as stemming from movement 240 and 245 as best shown in FIGS. 25 and 26, albeit for the back embodiment 60 only being shown. Further, the arm 78 also has a handle 101 disposed on the distal end portion 80 or bench push up end end portion 93 that is used to removably engage a portion of the user's 225 anatomy 230 wherein the handle 101 is pivotally movable 102 to better accommodate the combined movement 250 as stemming from movement 240 and 245 as best shown in FIGS. 12, 13, and 14 albeit for the chest embodiment 55 only being shown. Further included is the means 105 for creating independently selectable variable resistance forces as previously described. Note, that the use of the combined 61 chest 55 and back 60 embodiments is simply a combination of the previously identified use Figures being 12, 13, and 14 plus FIGS. 25 and 26 respectively.

Method of Use

Referring in particular to FIGS. 12 through 14 for the chest embodiment 55, being in the at rest positional state 260, in the extended positional state 265 about the second axis 125 only, and in the extended positional state 270 about the first 110 and second 125 axes respectively, a method of using the exercise apparatus 50 is disclosed. In addition, in referring to FIGS. 25 and 26 for the back embodiment 60, being the at rest positional state 261 and the extended positional state 271 about the first 110 and second 125 axes respectively, a method of using the exercise apparatus 50 is disclosed. The exercise apparatus 50 including the chest embodiment 55, the back embodiment 60, and the combined chest and back embodiment 61 starts with the step of firstly providing an exercise apparatus 50 that has the base structure 65, the arm 75, 76, 77, or 78 including a distal end portion 80, an intermediate portion 92 (arm 78 only) and a proximal end portion 85 with a longitudinal axis 89 (90 for arm 78) spanning therebetween. Further included in the exercise apparatus 50 is the multiple axes pivotal mechanism 70 disposed adjacent to the base structure 65, the mechanism 70 is sized and configured such that the arm proximal end portion 85 (intermediate portion 92 for arm 78) pivotally rotates about at least two axes that include the rotation 115 about the first axis 110 in a first rotational arc movement 120 and the arm proximal end portion 85 also pivotally rotates 130 about a second axis 125 in a second rotational arc of movement resistance 135. The first 110 and second 125 axes are substantially perpendicularly 140 oriented to one another and the arm distal 80 and proximal 85 end portions are adapted to provide at least two independent resistive forces 95 to muscle exertion. Also provided is the means 105 for creating independently selectable variable resistance forces to each of the first rotational arc of movement 120 resistance 185 and to the second rotational arc of movement 135 resistance 210 relative to the structure 65 corresponding to the two independent resistive forces 185 and 210.

Further, a next step is in selecting a first selected weight plate resistance 200 to the first rotational arc movement 120 and subsequently selecting a second selected weight plate resistance 220 to the second rotational arc of movement resistance 135. Continuing, in attaching 235 a portion of a user's 225 anatomy 230 to the distal end portion 80, see FIGS. 12, 13, and 14 (or proximal end portion 85, see FIGS. 25 and 26) of the arm 75, 76, 77, or 78 by a user 225. Note that the user's 225 anatomy 230, could be a hand, arm, shoulder, torso, leg, ankle, or any other portion of the user's 225 anatomy 230. Next, a step of manually moving 240 the distal end portion 80 (proximal end portion 85) by the user 225 in the first rotational arc movement 120 overcoming the first selected weight plate resistance 200 and manually moving 245 the distal end portion 80 (proximal end portion 85) by the user 225 in the second rotational arc of movement resistance 135 overcoming the second selected weight plate resistance 220. Alternatively, the steps of manual movement 240 and 245 as previously described can be combined by the user 225 into a single combined motion 250 of varying combined proportions of manual movements 240 and 245 such that the first 120 and second 135 rotational arc movements of resistance are combined into the single combined motion 250 while maintaining separate and independent the primary or first 185 and second resistances 210 that is operational to provide independent movement resistance against multiple specific muscles in the single combined motion 250 for higher workout efficiencies by exercising more muscles in less time, as best shown in FIGS. 14 and 26.

CONCLUSION

Accordingly, the present invention of a multi-axes exercise apparatus 50, 55, 60, and 61 has been described with some degree of particularity directed to the embodiment of the present invention. It should be appreciated, though; that the present invention is defined by the following claims construed in light of the prior art so modifications of the changes may be made to the exemplary embodiment of the present invention without departing from the inventive concepts contained therein.

The invention claimed is:

1. An exercise apparatus, comprising:

(a) a base structure;

(b) a multiple axes pivotal mechanism directly connected to said base structure, wherein said pivotal mechanism pivotally rotates about a first axis and also pivotally rotates about a second axis, wherein said first and second axes are independent in pivotal rotation and perpendicularly oriented to one another, said pivotal mechanism is sized and configured such that said first and second axes intersect in the same plane;

(c) an arm including a distal end portion and a proximal end portion with a longitudinal axis spanning therebetween, said proximal end portion is directly connected to said pivotal mechanism wherein said pivotal mechanism is sized and configured such that said arm proximal end portion pivotally rotates about said first axis in a first rotational arc of movement resistance and said arm proximal end portion also pivotally rotates about said second axis in a second rotational arc of movement resistance, wherein operationally two independent arm movements about said first and second axes occur in said arm relative to said base structure, wherein said arm pivots about a single point in space that is defined by said first and second axes same plane perpendicular intersection, to facilitate a constant moment arm distance along said longitudinal axis to said plane, said distal and proximal end portions are adapted to provide to each of said first and second rotational arcs of movement an independent resistance to facilitate muscle contraction from a muscle tension free state;

(d) a first assemblage directly connected to said base structure for creating an independently selectable variable resistance force is sized and configured such that said first rotational arc of movement resistance is created by said first assemblage; and (e) a second assemblage directly connected to said base structure for creating an independently selectable variable resistance force is sized and configured such that said second rotational arc of movement resistance is created by said second assemblage, wherein said first and second assemblages are independent of one another, such that operationally said first assemblage can have a first selected resistance and said second assemblage can be selected to have no resistance or said second assemblage can have a second selected resistance and said first assemblage can be selected to have no resistance or said first assemblage can have said first selected resistance and said second assemblage can have said second selected resistance, operationally to facilitate said constant moment arm distance along said longitudinal axis to said plane, said first and second assemblages create independently selectable variable resistance forces, on each of said first and second rotational arcs of movement resistance to operationally help facilitate said arm to include a combined motion by simultaneously pivotally rotating about both said first and second axes.

2. An exercise apparatus according to claim 1 wherein said pivotal mechanism is formed from a yoke element that is pivotally attached to said base structure about said first axis and said arm proximal end portion is pivotally attached to said yoke about said second axis.

3. An exercise apparatus according to claim 1 wherein said first assemblage is also directly connected to said proximal end portion and said second assemblage is also directly connected to said distal end portion.

4. An exercise apparatus according to claim 3 wherein said first assemblage is constructed of a flexible component that communicates said first rotational arc of movement resistance from said proximal end portion to a first selected weight plate movably disposed upon said base structure and said second assemblage is constructed of a retainer extension that removably engages a second selected weight plate.

5. An exercise apparatus, comprising:

(a) a base structure;

(b) a multiple axes pivotal mechanism directly connected to said base structure, wherein said pivotal mechanism pivotally rotates about a first axis and also pivotally rotates about a second axis, wherein said first and second axes are independent in pivotal rotation and perpendicularly oriented to one another, said pivotal mechanism is sized and configured such that said first and second axes intersect in the same plane;

(c) an arm including a distal end portion and a proximal end portion with a longitudinal axis spanning therebetween, said distal end portion is directly connected to said pivotal mechanism wherein said pivotal mechanism is sized and configured such that said arm proximal end portion pivotally rotates about said first axis in a first rotational arc of movement resistance and said arm proximal end portion also pivotally rotates about said second axis in a second rotational arc of movement resistance, wherein operationally two independent arm movements about said first and second axes occur in said arm relative to said base structure, wherein said arm pivots about a single point in space that is defined by said first and second axes same plane perpendicular intersection, to facilitate a constant moment arm distance along said longitudinal axis to said plane, said distal and proximal end portions are adapted to provide to each of said first and second rotational arcs of movement an independent resistance to facilitate muscle contraction from a muscle tension free state;

(d) a first assemblage directly connected to said base structure for creating an independently selectable variable resistance force is sized and configured such that said first rotational arc of movement resistance is created by said first assemblage; and (e) a second assemblage directly connected to said base structure for creating an independently selectable variable resistance force is sized and configured such that said second rotational arc of movement resistance is created by said second assemblage, wherein said first and second assemblages are independent of one another, such that operationally said first assemblage can have a first selected resistance and said second assemblage can be selected to have no resistance or said second assemblage can have a second selected resistance and said first assemblage can be selected to have no resistance or said first assemblage can have said first selected resistance and said second assemblage can have said second selected resistance, operationally to facilitate said constant moment arm distance along said longitudinal axis to said plane, said first and second assemblages create independently selectable variable resistance forces, on each of said first and second rotational arcs of movement resistance to operationally help facilitate said arm to include a combined motion by simultaneously pivotally rotating about both said first and second axes.

6. An exercise apparatus according to claim 5 wherein said pivotal mechanism is formed from a yoke element that is pivotally attached to said base structure about said first axis and said arm proximal end portion is pivotally attached to said yoke about said second axis.

7. An exercise apparatus according to claim 5 wherein said first assemblage and said second assemblage are both also directly connected to said proximal end portion.

8. An exercise apparatus according to claim 7 wherein said first assemblage is constructed of a flexible component that communicates said first rotational arc of movement resistance from said distal end portion to a first selected weight plate movably disposed upon said base structure and said second assemblage is constructed of a retainer extension that removably engages a second selected weight plate.

9. An exercise apparatus, comprising:

(a) a base structure;

(b) a multiple axes pivotal mechanism directly connected to said base structure, wherein said pivotal mechanism pivotally rotates about a first axis and also pivotally rotates about a second axis, wherein said first and second axes are independent in pivotal rotation and perpendicularly oriented to one another, said pivotal mechanism is sized and configured such that said first and second axes intersect in the same plane;

(c) an arm including a lat pull down end portion, an intermediate portion, and a bench push up end portion with a longitudinal axis spanning therebetween, said intermediate portion is directly connected to said pivotal mechanism wherein said pivotal mechanism is sized and configured such that said arm intermediate portion pivotally rotates about said first axis in a first rotational arc of movement resistance and said arm intermediate portion also pivotally rotates about said second axis in a second rotational arc of movement resistance, wherein operationally two independent arm movements about said first and second independent axes occur in said arm relative to said base structure, wherein said arm pivots about a single point in space that is defined by said first and second axes same plane perpendicular intersection, to facilitate a constant moment arm distance along said longitudinal axis to said plane, said lat pull down end portion and said bench press up end portion are adapted to provide to each of said first and second rotational arcs of movement an independent resistance to facilitate muscle contraction from a muscle tension free state;

(d) a first assemblage directly connected to said base structure for creating an independently selectable variable resistance force is sized and configured such that said first rotational arc of movement resistance is created by said first assemblage; and (e) a second assemblage directly connected to said base structure for creating an independently selectable variable resistance force is sized and configured such that said second rotational arc of movement resistance is created by said second assemblage, wherein said first and second assemblages are independent of one another, such that operationally said first assemblage can have a first selected resistance and said second assemblage can be selected to have no resistance or said second assemblage can have a second selected resistance and said first assemblage can be selected to have no resistance or said first assemblage can have said first selected resistance and said second assemblage can have said second selected resistance, operationally to facilitate said constant moment arm distance along said longitudinal axis to said plane, said first and second assemblages create independently selectable variable resistance forces, on each of said first and second rotational arcs of movement resistance to operationally help facilitate said arm to include a combined motion by simultaneously pivotally rotating about both said first and second axes.

10. An exercise apparatus according to claim 9 wherein said pivotal mechanism is formed from a yoke element that is pivotally attached to said base structure about said first axis and said arm intermediate portion is pivotally attached to said yoke about said second axis.

11. An exercise apparatus according to claim 9 wherein said first assemblage is also directly connected to said lat pull down end portion and said second assemblage is also directly connected to said bench push up end portion.

12. An exercise apparatus according to claim 11 wherein said first assemblage is constructed of a flexible component that communicates movement from said lat pull down end portion to a first selected weight plate movably disposed upon said base structure and said second assemblage is constructed of a retainer extension that removably engages a second selected weight plate.

* * * * *